US009625861B2

(12) United States Patent
Okuda

(10) Patent No.: US 9,625,861 B2
(45) Date of Patent: Apr. 18, 2017

(54) SHEET COOLING APPARATUS AND IMAGE FORMING APPARATUS

(71) Applicant: CANON KABUSHIKI KAISHA, Tokyo (JP)

(72) Inventor: Kazuhisa Okuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/930,128

(22) Filed: Jun. 28, 2013

(65) Prior Publication Data

US 2014/0029995 A1 Jan. 30, 2014

(30) Foreign Application Priority Data

Jul. 26, 2012 (JP) ..... 2012-166069

(51) Int. Cl.
*G03G 15/20* (2006.01)
*G03G 15/00* (2006.01)
*G03G 21/20* (2006.01)

(52) U.S. Cl.
CPC ..... *G03G 15/2039* (2013.01); *G03G 15/2021* (2013.01); *G03G 15/6573* (2013.01); *G03G 21/206* (2013.01); *G03G 2215/00662* (2013.01); *G03G 2221/1645* (2013.01)

(58) Field of Classification Search
CPC ..... B65H 29/12; B65H 2301/51256; F28D 15/0208; G03G 15/6576; G03G 15/6573; G03G 15/2021; G03G 21/206; G03G 2215/00662; G03G 2221/1645; G03G 15/2039
USPC ..... 399/406, 341; 271/198
See application file for complete search history.

(56) References Cited

U.S. PATENT DOCUMENTS

| | | | | |
|---|---|---|---|---|
| 4,064,933 | A * | 12/1977 | Schuman | 165/89 |
| 5,761,535 | A * | 6/1998 | Neifert et al. | 710/62 |
| 7,480,480 | B2 | 1/2009 | Endo et al. | |
| 7,489,895 | B2 * | 2/2009 | Tani | 399/329 |
| 7,505,725 | B2 | 3/2009 | Katayama et al. | |
| 7,546,078 | B2 | 6/2009 | Okuda et al. | |
| 8,554,097 | B2 | 10/2013 | Hara et al. | |
| 2011/0318078 | A1 * | 12/2011 | Aoi | 399/381 |
| 2012/0074638 | A1 * | 3/2012 | Nakagaki | 271/4.06 |

FOREIGN PATENT DOCUMENTS

| | | | | |
|---|---|---|---|---|
| JP | S58-100056 | * | 6/1983 | B65H 29/12 |
| JP | 2004-145160 | * | 5/2004 | G03G 15/20 |
| JP | 2007-086282 | * | 4/2007 | G03G 21/20 |
| JP | 2008-265975 | * | 11/2008 | B65H 29/70 |

(Continued)

*Primary Examiner* — David Gray
*Assistant Examiner* — Michael Harrison
(74) *Attorney, Agent, or Firm* — Fitzpatrick, Cella, Harper & Scinto

(57) ABSTRACT

A sheet cooling apparatus cools a sheet while conveying the sheet having passed through a fixing device for fixing an unfixed toner image formed on the sheet by heating the toner image. A second suspension member is arranged so as to press a second endless belt on a circumferential face of a first cooling roller through a first endless belt, a first suspension member is arranged so as to press the first endless belt on a circumferential face of a second cooling roller through the second endless belt, and a curved sheet conveying path is formed between the first endless belt and the second endless belt.

20 Claims, 20 Drawing Sheets

(56) References Cited

FOREIGN PATENT DOCUMENTS

| | | |
|---|---|---|
| JP | 2009161347 | 7/2009 |
| JP | 2009175260 | 8/2009 |
| JP | 4766054 | 9/2011 |
| JP | 5086110 | 11/2012 |

* cited by examiner

SHEET COOLING APPARATUS AND IMAGE FORMING APPARATUS

BACKGROUND OF THE INVENTION

Field of the Invention

The present invention relates to a sheet cooling apparatus used for cooling a sheet, which is formed from paper fibers or the like, that is a target for heating, pressing, and fixing an unfixed toner image in an image forming apparatus such as a copying machine, a printer, or a facsimile machine.

Description of the Related Art

Conventionally, in image forming apparatuses such as electro-photographic apparatuses and electrostatic recording apparatuses, an image is formed on a sheet by forming a toner image on the sheet as a recording material and fixing the toner image using a fixing device by heating and pressing the toner image. As fixing devices used in such image forming apparatuses, a roller fixing system is employed in which a pressing nip portion (fixing nip portion) is formed by pressing a pressure roller to a fixing roller having an internal heater and performing fixing by performing heating and pressing in the pressing nip portion.

In a fixing device of the roller fixing system, heat is applied to toner and a sheet, and accordingly, moisture contained in the sheet evaporates in the pressing nip portion and after passing the pressing nip portion. Then, ripples and curls occur due to a change in the amount of moisture of the sheet and stress applied to the sheet.

When a sheet is viewed in the level of fibers, the sheet is formed by entangling short fibers with each other, moisture is contained inside the fibers or between the fibers, and the fibers and water generate hydrogen bonding. In a fixing process, when heat is applied to the sheet, the moisture included inside the sheet evaporates, and accordingly, the hydrogen bonding occurs between the fibers, whereby the sheet is deformed. When the sheet is left around, the sheet absorbs moisture from the environment, and the hydrogen bonding between the fibers is broken again. However, moisture is not permeated between some fibers, whereby the deformation is maintained.

As a pattern of the deformation, there are deformations according to a difference in the expansion and contraction between the front and rear sides of a sheet and deformation according to a difference in the expansion and contraction between a center portion and an end portion of a sheet. In accordance with such deformation, ripples and curls occur in the sheet.

In order to solve such a problem, a configuration is disclosed in which the sheet is cooled as below.

In Japanese Patent Laid-Open No. 2009-161347, a bending portion bending in a direction opposite to the bending of a sheet on which an image is fixed by a fixing portion in the conveying direction is included. In addition, a cooling member that cools a sheet conveyed by a belt member through the belt member in an area including the bending portion and a pressing member that presses a sheet to the bending portion side of the cooling member are included.

In Japanese Patent Laid-Open No. 2009-175260, a configuration is disclosed in which an endless belt member having good heat conductivity is stretched over belt cooling rollers that are aligned from a fixing device in the conveying direction. Then, a sheet heated by the fixing device is brought into contact with the endless belt member stretched between the belt rollers so as to be cooled, and the endless belt member heated by the sheet is cooled by the belt cooling rollers.

However, among the above-described conventional technologies, in the technology disclosed in Japanese Patent Laid-Open No. 2009-161347, there is concern that tension of the belt member may increase, and deterioration due to abrasion caused by a contact load of the belt member for the cooling member may become serious.

In addition, in the technology disclosed in Japanese Patent Laid-Open No. 2009-175260, since the contact area between the endless belt member and the belt cooling rollers is small, there is concern that the heat transfer to the endless belt member is lowered in accordance with an increase in the number of continuously passing sheets.

SUMMARY OF THE INVENTION

It is desirable to improve the durability by decreasing the abrasion of a cooling belt and members brought into contact with the inner face of the cooling belt and to realize improvement of the cooling ability.

According to the invention, there is provided a sheet cooling apparatus that cools a sheet while conveying the sheet passing through a fixing device fixing an unfixed toner image formed on the sheet by heating the toner image. The sheet cooling apparatus includes: a first endless belt that is suspended on a first cooling roller and a first suspension member arranged downstream of the first cooling roller in a conveying direction; and a second endless belt that is suspended on a second cooling roller arranged downstream of the first cooling roller in the conveying direction and a second suspension member arranged upstream of the second cooling roller in the conveying direction; wherein the second suspension member is arranged so as to press the second endless belt on a circumferential face of the first cooling roller through the first endless belt, the first suspension member is arranged so as to press the first endless belt on a circumferential face of the second cooling roller through the second endless belt, and a curved sheet conveying path is formed between the first endless belt and the second endless belt.

According to the invention, by using the cooling roller, the conveying resistance due to friction with a belt can be markedly lower than that of the fixed type, and accordingly, the belts and the sheet can be conveyed in a stable manner, and the driving load can be reduced.

In addition, by forming the curved conveying path bent in the shape of "S" along the circumferential face of the cooling roller, the belt and each cooling roller can be brought into contact with each other in the entire area of the sheet conveying path, whereby the cooling efficiency for the sheet can be improved.

Furthermore, by forming the curved conveying path bent in the shape of "S" other than a conveying path having an approximately linear shape, the miniaturization of the whole apparatus can be achieved, and the curl and the ripple can be reduced by acquiring a curl correction effect for the sheet.

Further features of the present invention will become apparent from the following description of exemplary embodiments with reference to the attached drawings.

DESCRIPTION OF THE EMBODIMENTS

Hereinafter, exemplary embodiments of the invention will be described in detail as examples with reference to the drawings. However, the sizes, the materials, the shapes, and the relative arrangements of constituent components described in the following embodiments should be appropriately changed in accordance with the configuration and various conditions of devices and apparatuses to which the invention is applied. Accordingly, unless there is specific description, the embodiments are not for purposes of limiting the scope of the invention thereto.

First Embodiment

A sheet cooling apparatus and an image forming apparatus including the sheet cooling apparatus will be described with reference to FIGS. 1 to 12.

Figure 2:
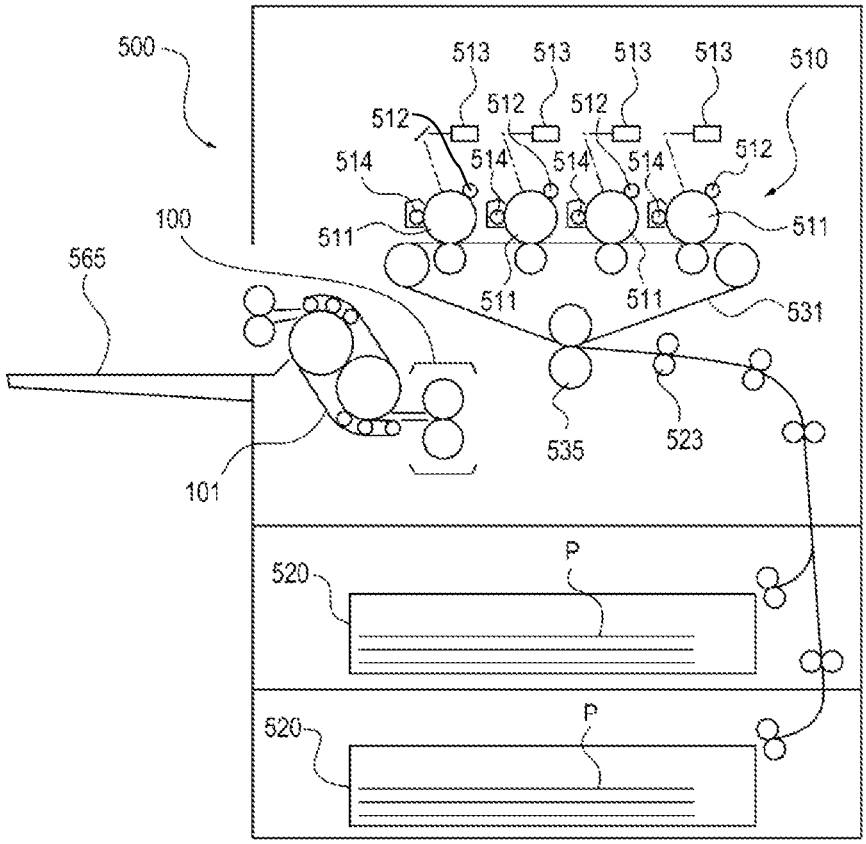
FIG. 2 is a cross-sectional view that illustrates an image forming apparatus including a sheet cooling apparatus.

FIG. 2 is a cross-sectional view of a color electro-photographic printer 500 as an example of the image forming apparatus according to this embodiment and is a cross-sectional view taken along the conveying direction of a sheet. In this embodiment, the color electro-photographic printer will be simply referred to as a "printer". On a sheet as a recording material, a toner image is formed. As specific examples of the sheet, there are plain paper, a sheet made from a resin that is a substitute for the plain paper, a cardboard, and an overhead projector sheet.

The printer 500 illustrated in FIG. 2 includes image forming portions 510 of colors Y (yellow), M (magenta), C (cyan), and Bk (black). In the image forming portions 510, toner images of each color to be formed on a sheet are formed. In each image forming portion 510, a photosensitive drum 511 as an image bearing member is electrically charged by a charging roller 512 in advance. Thereafter, a latent image is formed on the photosensitive drum 511 by a laser scanner 513. The latent image is formed as a toner image by a development device 514. The toner images formed on the photosensitive drum 511 are transferred to an intermediate transfer belt 531 as an intermediate transfer member in a sequentially superimposed manner.

Sheets P as recording materials are sent from a sheet cassette 520 one by one and are conveyed to a pair of registration rollers 523. The pair of registration rollers 523 receives the sheet P once and, in a case where the sheet P is fed on a skew, the skew feeding is immediately corrected. Then, the pair of registration rollers 523 sends the sheets P between the intermediate transfer belt 531 and a secondary transfer roller 535 in synchronization with a toner image formed on the intermediate transfer belt 531. The color toner images formed on the intermediate transfer belt 531 are transferred together to the sheet P by the secondary transfer roller 535 as a transfer portion.

Thereafter, the unfixed toner images T formed on the sheet P are fixed to the sheet P by being heated and pressed by a fixing device 100. After passing through the fixing device 100, the sheet P is cooled while being conveyed to the inside of a cooling apparatus 101 as a sheet cooling apparatus and is discharged to a discharge tray 565 with the face up (the toner image is disposed on the upper side).

The fixing device 100 and the cooling apparatus 101 as a sheet cooling apparatus will be described with reference to FIGS. 1, 3, and 4. First, the fixing device 100 will be described with reference to FIG. 1, and then, the cooling apparatus 101 will be described with reference to FIGS. 1, 3, and 4.

Figure 1:
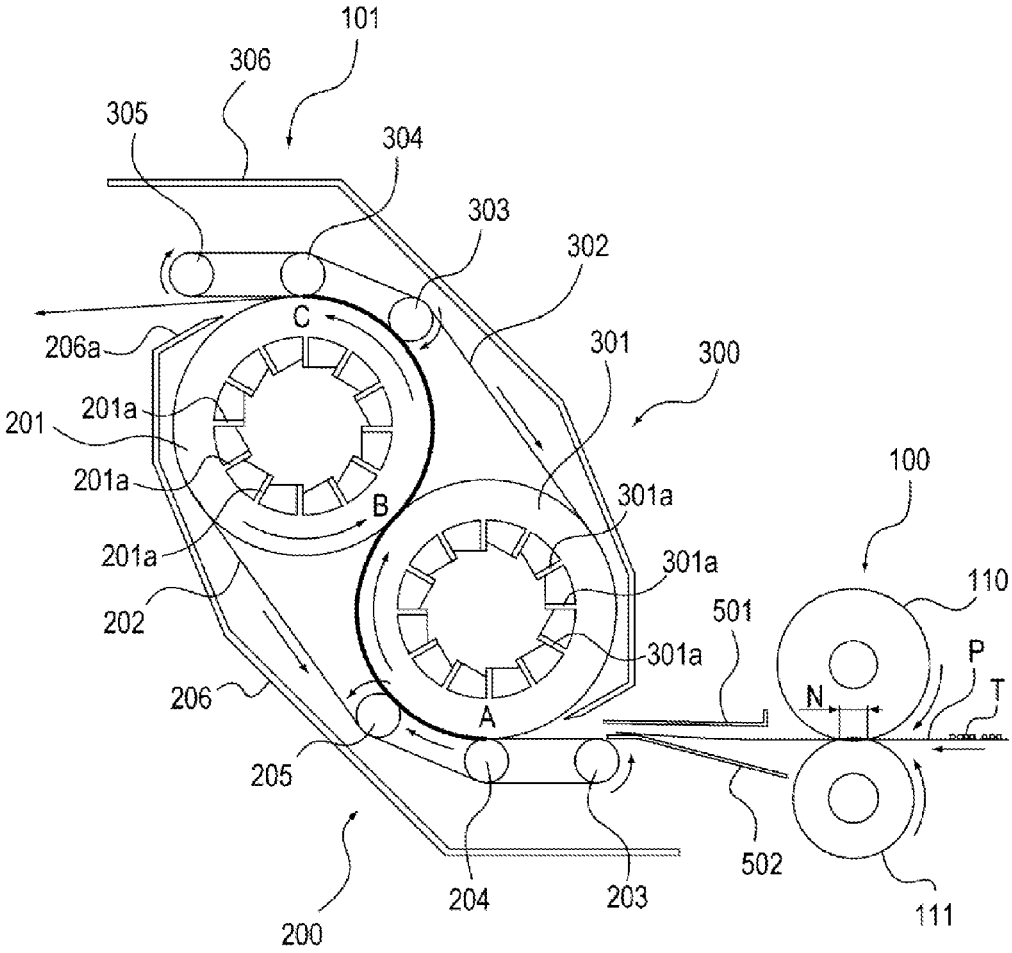
FIG. 1 is a cross-sectional view that illustrates a sheet cooling apparatus according to a first embodiment.

As illustrated in FIG. 1, the fixing device 100 includes a fixing roller 110 as a fixing member and a pressure roller 111 as a pressure member. The fixing roller 110 applies heat emitted from an internal halogen heater (not illustrated in the figure) to the toner image T formed on the sheet P and conveys the sheet P cooperatively with a pressure roller 111. The fixing roller 110, for example, includes a metal core formed from an aluminum cylindrical pipe having an outer diameter of 56 mm and an inner diameter of 50 mm, and a halogen heater is built inside the metal core. In addition, the fixing roller 110 is acquired by coating the surface of the metal core with an elastic layer formed from silicon rubber, for example, having a thickness of 2 mm and a hardness (ASKER C) of 45° and further coating the surface layer of the elastic layer with a PFA or PTFE heat-resistant toner parting layer.

The pressure roller 111 conveys the sheet P cooperatively with the fixing roller 110. The pressure roller 111 includes a metal core formed by an aluminum cylindrical pipe, for example, having an outer diameter of 56 mm and an inner diameter of 50 mm. In addition, the pressure roller 111 is acquired by coating the surface of the metal core with an elastic layer formed from silicon rubber, for example, having a thickness of 2 mm and a hardness (ASKER C) of 45° and further coating the surface layer of the elastic layer with a PFA or PTFE heat-resistant toner parting layer.

The fixing device 100 forms a fixing nip (pressing nip) N illustrated in FIG. 1 by using the fixing roller 110 and the pressure roller 111.

The sheet P that is conveyed to the fixing device 100 by the photosensitive drum 511 and the transfer roller 535 enters the fixing nip N of the fixing roller 110 and the pressure roller 111. The fixing roller 110 is heated and pressed inside the fixing nip N formed by the fixing roller 110 and the pressure roller 111, whereby the unfixed toner image T is fixed to the sheet P. The sheet P on which the image is fixed, as illustrated in FIG. 1, is guided to an area between an upper discharge guide 501 and a lower discharge guide 502.

The sheet P discharged from the fixing device 100 is guided to the cooling apparatus 101 by the guides 501 and 502 and is cooled so as to remove the heat applied by the fixing device 100 while being conveyed by the cooling apparatus 101.

As illustrated in FIG. 1, the sheet P guided to an area between the upper discharge guide 501 and the lower discharge guide 502 is conveyed to an area between cooling belts 302 and 202 used for nipping and conveying the sheet P in the cooling apparatus 101 while contacting the front surface and the rear surface of the sheet P.

The cooling belts 302 and 202 are endless belts (endless belt members) that are brought into contact with the face of a sheet and convey the sheet. The cooling belts 302 and 202 may be formed from a material having superior thermal conductivity and may be formed from a material such as a polyimide film, a nickel electroformed film, or a polyethylene film that can form a thin plate.

The cooling belt 202 as a second endless belt performs frictional conveyance while being brought into contact with the rear surface of the sheet P. This cooling belt 202, as illustrated in FIG. 1, is stretched over the outer circumferences of a cooling roller 201 as a second cooling roller and belt pressure rollers 204 and 205 as second suspension members and a tension roller 203. Tension is applied to the cooling belt 202 by the tension roller 203.

The cooling roller 201 is arranged on the downstream of a cooling roller 301 as a first cooling roller to be described later in the conveying direction. The belt pressure rollers 204 and 205 as the second suspension members and the tension roller 203 are arranged on the upstream of the cooling roller 201 in the conveying direction.

Figure 3:
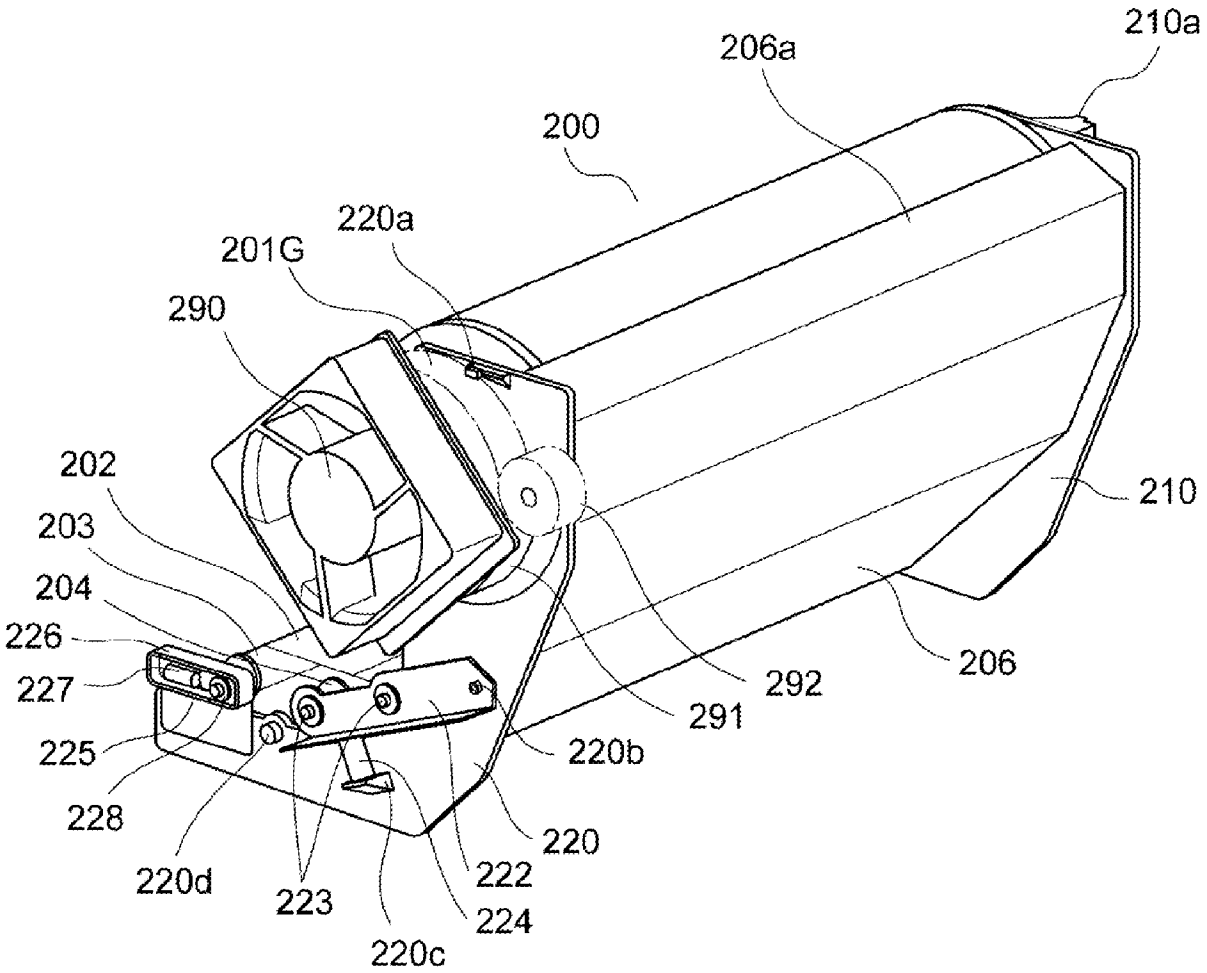
FIG. 3 is an external view that illustrates a cooling belt unit according to the first embodiment.

The cooling belt 202, the cooling roller 201, the belt pressure rollers 204 and 205, and the tension roller 203, as illustrated in FIG. 3, configure an independent cooling belt unit 200.

Figure 4:
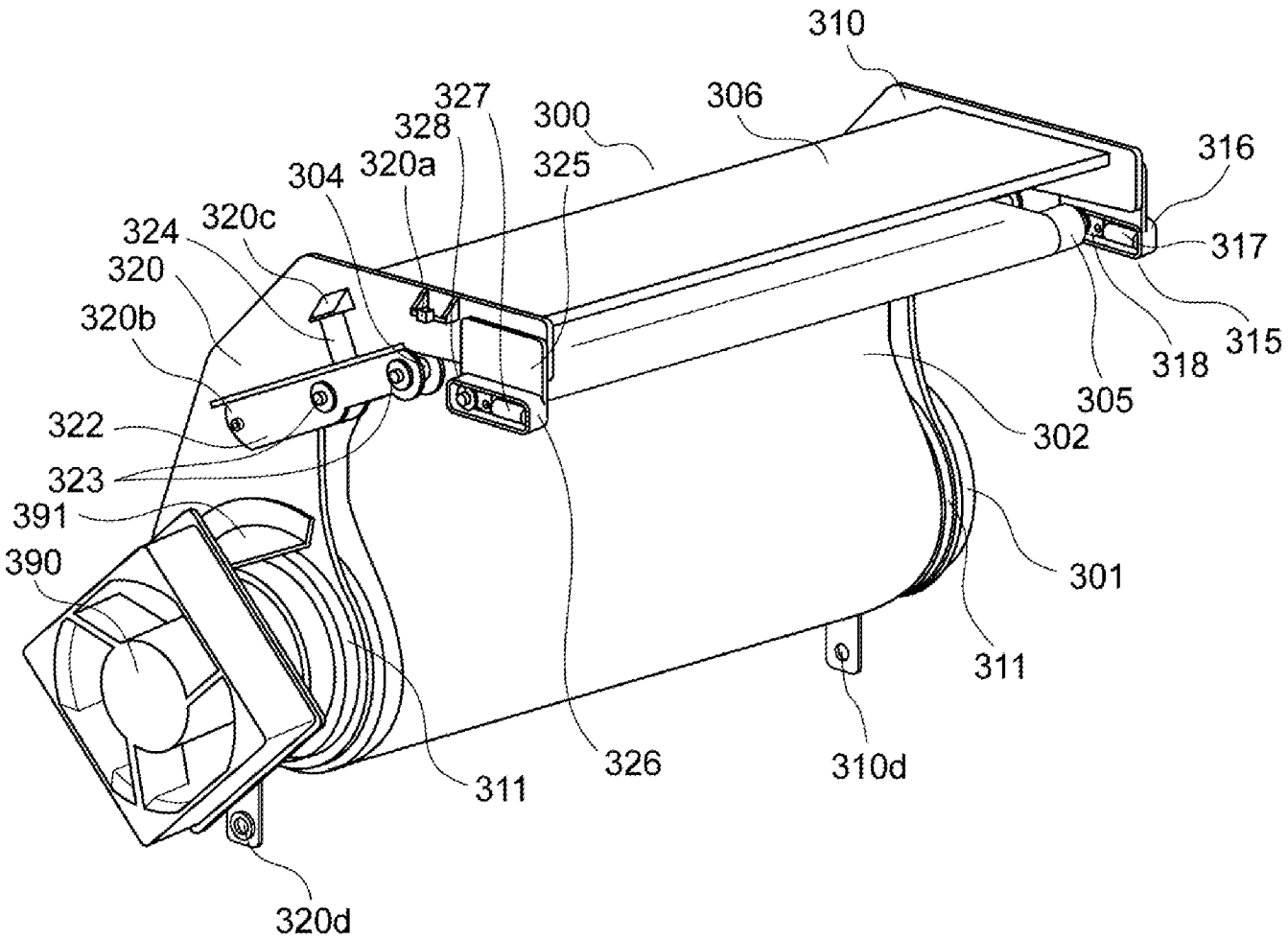
FIG. 4 is an external view that illustrates the cooling belt unit according to the first embodiment.
Figure 5:
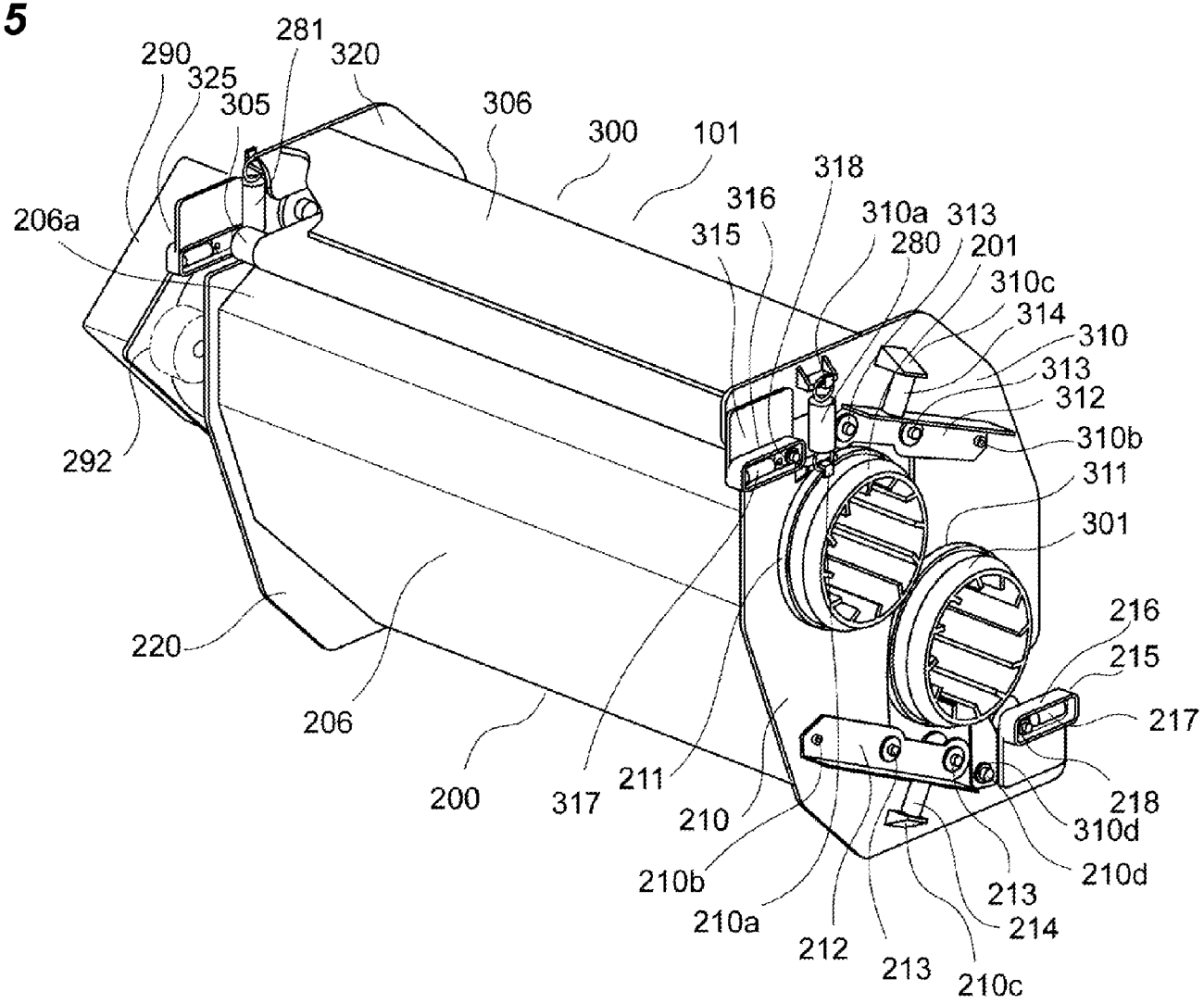
FIG. 5 is an external view that illustrates a sheet cooling apparatus according to the first embodiment.

The cooling roller 201, as illustrated in FIGS. 3 to 5, is supported to be rotatable through a cooling roller bearing 211 by a front side plate 210 and a rear side plate 220 that configure the frame of the cooling belt unit 200. The front side plate 210 and the rear side plate 220 are connected and fixed to both end portions of a stay 206, thereby forming the frame of the cooling belt unit 200. An upper end portion 206*a* of the stay 206, as illustrated in FIG. 1, serves also as a discharge guide that guides the lower face side of the sheet P discharged from an exit portion C of a conveyance nip of the cooling apparatus 101.

Figure 6A:
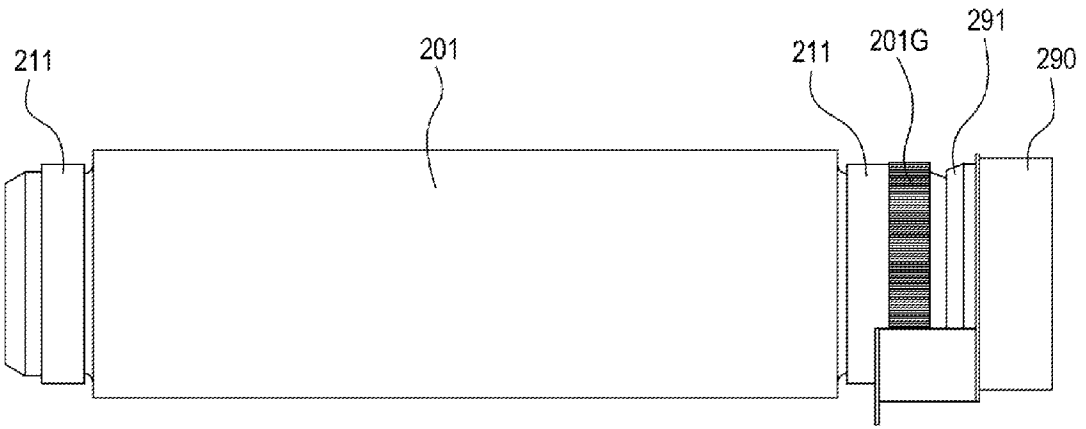
FIGS. 6A and 6B are side views that illustrate cooling rollers according to the first embodiment.
Figure 7A:
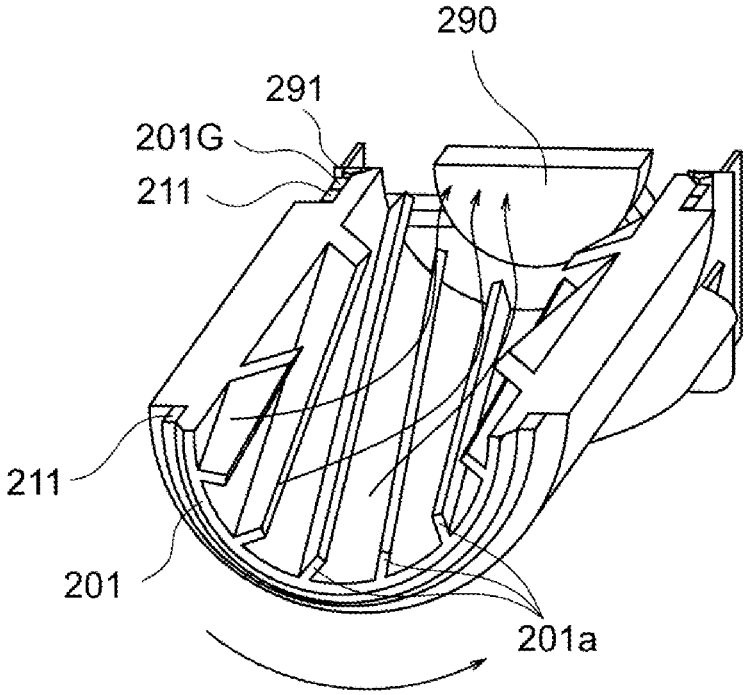
FIGS. 7A and 7B are partial cross-sectional views that illustrate the cooling rollers according to the first embodiment.

As illustrated in FIGS. 3, 6A, and 7A, a cooling roller driving gear 201G is fixed to an outer side adjacent to one cooling roller bearing 211 of the cooling roller 201. In addition, a cooling duct 291 used for guiding cooling air to a cooling fan 290 from an internal cavity of the cooling roller 201 is disposed on a face that is located on the outer side further adjacent to the cooling roller driving gear 201G and on the outer side of the rear side plate 220. The cooling duct 291 is connected and fixed to the cooling roller driving gear 201G in a non-contact manner on the same axis so as not to block rotation of the cooling roller 201. A cooling fan 290 is fixed to a further outer face of the cooling duct 291. In other words, in order to cause cooling air to flow to the inside the cooling roller 201, the cooling fan 290 is disposed in one end portion in the direction of the rotation shaft of the cooling roller 201.

On the outer face of the rear side plate 220, as illustrated in FIGS. 3 and 5, a driving input gear 292 is supported to be rotatable so as to be engaged with the cooling roller driving gear 201G and is supplied with a driving force from a driving motor that is a driving source not illustrated in the figure.

The belt pressure rollers 204 and 205, as illustrated in FIGS. 3 and 5, are supported to be rotatable through bearings 213 and 223 by pressure arms 212 and 222. In addition, the pressure arms 212 and 222 are supported to be swingable by pressure arm supporting shafts 210*b* and 220*b* that are integrally formed on the side faces of the front side plate 210 and the rear side plate 220.

Between pressure spring bearing faces 210*c* and 220*c* integrally formed on the outer faces of the front side plate 210 and the rear side plate 220 and the pressure arms 212 and 222, pressure springs 214 and 224 of the compression coil type are inserted, and the pressure springs 214 and 224 bias the pressure arms 212 and 222 in a direction pushing them up. Accordingly, the belt pressure rollers 204 and 205 supported by the pressure arms 212 and 222 among a plurality of second suspension members are pressed to the cooling roller 301 through the cooling belts 302 and 202. Here, although a configuration has been described as an example in which two rollers 204 and 205 among the plurality of second suspension members, which are disposed, are pressed to the cooling roller 301, the configuration is not limited thereto, and at least one suspension member may be pressed to the cooling roller.

On the outer faces of the front side plate 210 and the rear side plate 220, belt tensioners 215 and 225 used for applying tension to the cooling belt 202 are arranged. Tension roller bearings 218 and 228 supporting both end portions of the tension roller 203 to be rotatable are supported also by hollow inner walls of tensioner holders 216 and 226 having hollow inner portions in the shape of a rectangle so as to be slidable in the horizontal direction in FIG. 1. In addition, the other ends of the tension springs 217 and 227 of the pulling coil type having one ends hooked into one hollow inner walls of the tensioner holders 216 and 226 are hooked into the tension roller bearings 218 and 228, and the tension roller bearings 218 and 228 are pulled and biased. Accordingly, as illustrated in FIGS. 1 and 5, in a state in which the cooling belt units 200 and 300 are contacted and pressed through the cooling belts 202 and 302, the tension roller 203 applies tension to the cooling belt 202 while being supported to be rotatable.

In addition, on the outer faces of the front side plate 210 and the rear side plate 220 used for supporting the tension roller 203, unit supporting shafts 210*d* and 220*d* used for supporting the front side plate 310 and the rear side plate 320 to be swingable are integrally formed. The front side plate 310 and the rear side plate 320 configure a frame of the cooling belt unit 300 that is the other cooling belt unit including the cooling belt 302 on the inside thereof.

Furthermore, in uppermost portions of the outer faces of the front side plate 210 and the rear side plate 220, unit pressure spring engaging portions 210*a* and 220*a*, as illustrated in FIG. 3, are formed integrally with the front side plate 210 and the rear side plate 220. The unit pressure spring engaging portions 210*a* and 220*a* are disposed so as to hook lower one ends of the unit pressure springs 280 and 281 of the compression coil type used for pressing the cooling belt units 200 and 300 illustrated in FIG. 5 toward each other.

The cooling belt 302 as a first endless belt performs frictional conveyance while being brought into contact with the front surface of the sheet P. This cooling belt 302, as illustrated in FIG. 1, is stretched over the outer circumferences of a cooling roller 301 as a first cooling roller and belt pressure rollers 303 and 304 as first suspension members and a tension roller 305. Tension is applied to the cooling roller 301 by the tension roller 305.

The cooling roller 301 is arranged on the upstream of the cooling roller 201 in the conveying direction as the second cooling roller described above. The belt pressure rollers 303 and 304 as the first suspension members and the tension roller 305 are arranged on the downstream of the cooling roller 301 in the conveying direction.

The cooling belt 302, the cooling roller 301, the belt pressure rollers 303 and 304, and the tension roller 305, as illustrated in FIG. 4, configure an independent cooling belt unit 300.

The cooling roller 301, as illustrated in FIG. 4, is supported to be rotatable through a cooling roller bearing 311 by a front side plate 310 and a rear side plate 320 that configure the frame of the cooling belt unit 300. The front side plate 310 and the rear side plate 320 are connected and fixed to both end portions of a stay 306, thereby forming the frame of the cooling belt unit 300.

Figure 6B:
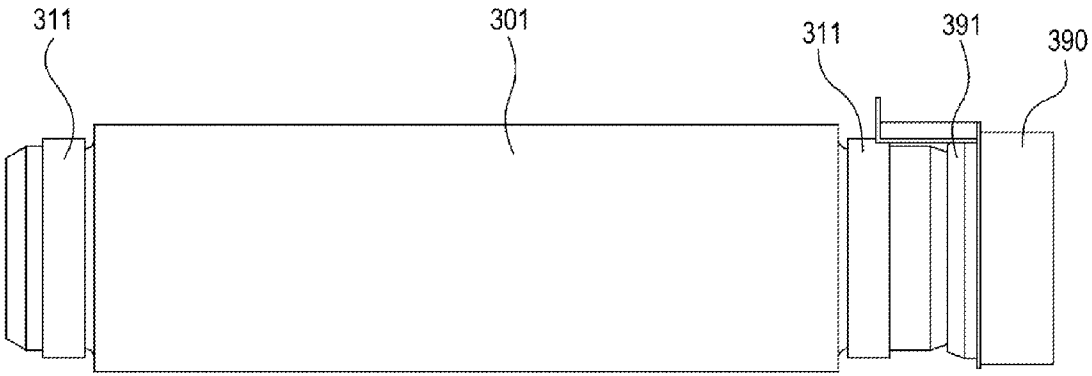
Figure 7B:
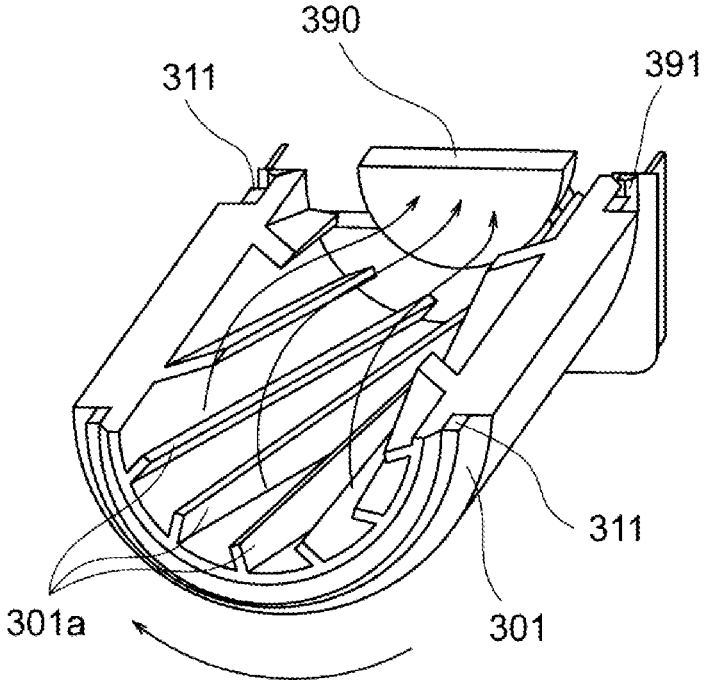

As illustrated in FIGS. 4, 6B, and 7B, a cooling duct 391 used for guiding cooling air to a cooling fan 390 from an internal cavity of the cooling roller 301 is disposed on an outer a face of the rear side plate 320, is connected and fixed on the same shaft in a non-contact manner so as not to block rotation of the cooling roller 301. A cooling fan 390 is fixed to a further outer face of the cooling duct 391. In other words, in order to allow cooling air to flow to the inside the cooling roller 301, the cooling fan 390 is disposed in one end portion in the direction of the rotation shaft of the cooling roller 301.

The belt pressure rollers 303 and 304, as illustrated in FIGS. 4 and 5, are supported to be rotatable through bearings 313 and 323 by pressure arms 312 and 322. In addition, the pressure arms 312 and 322 are supported to be swingable by pressure arm supporting shafts 310*b* and 320*b* that are integrally formed on the side faces of the front side plate 310 and the rear side plate 320.

Between pressure spring bearing faces 310*c* and 320*c* integrally formed on the outer faces of the front side plate 310 and the rear side plate 320 and the pressure arms 312 and 322, pressure springs 314 and 324 of the compression coil type are inserted, and the pressure springs 314 and 324 bias the pressure arms 312 and 322 in a direction pushing them down. Accordingly, the belt pressure rollers 303 and 304 supported by the pressure arms 312 and 322 among a plurality of first suspension members are pressed to the cooling roller 201 through the cooling belts 302 and 202. Here, although a configuration has been described as an example in which two rollers 303 and 304 among the plurality of first suspension members, which are disposed, are pressed to the cooling roller 201, the configuration is not limited thereto, and at least one suspension member may be pressed to the cooling roller.

On the outer faces of the front side plate 310 and the rear side plate 320, belt tensioners 315 and 325 used for applying tension to the cooling belt 302 are arranged. Tension roller bearings 318 and 328 supporting both end portions of the tension roller 305 to be rotatable are supported also by hollow inner walls of tensioner holders 316 and 326 having hollow inner portions in the shape of a rectangle so as to be slidable in the horizontal direction in FIG. 1. In addition, the other ends of the tension springs 317 and 327 of the pulling coil type having one ends hooked into one hollow inner walls of the tensioner holders 316 and 326 are hooked into the tension roller bearings 318 and 328, and the tension roller bearings 318 and 328 are pulled and biased. Accordingly, as illustrated in FIGS. 1 and 5, in a state in which the cooling belt units 200 and 300 are contacted and pressed through the cooling belts 202 and 302, the tension roller 305 applies tension to the cooling belt 302 while being supported to be rotatable.

In addition, on the outer faces of the front side plate 310 and the rear side plate 320 used for supporting the tension roller 305, bearings 310*d* and 320*d* used for allowing the front side plate 310 and the rear side plate 320 to be supported by the unit supporting shafts 210*d* and 220*d* on the side faces of the front side plate 210 and the rear side plate 220 to be swingable are held. The front side plate 210 and the rear side plate 220 configure a frame of the cooling belt unit 200 that is the other cooling belt unit including the cooling belt 202 on the inside thereof.

Furthermore, in uppermost portions of the outer faces of the front side plate 310 and the rear side plate 320, unit pressure spring engaging portions 310*a* and 320*a* for hooking upper one ends of the unit pressure springs 280 and 281 are integrally formed. The unit pressure springs 280 and 281 are disposed for pressing the cooling belt units 200 and 300 illustrated in FIGS. 4 and 5 each other.

In the cooling belt units 200 and 300, the unit supporting shafts 210*d* and 220*d* disposed on the side faces of the front side plate 210 and the rear side plate 220 fit into the bearings 310*d* and 320*d* held on the side faces of the front side plate 310 and the rear side plate 320. The cooling rollers 201 and 301 contact each other at a point B illustrated in FIG. 1 through the cooling belts 202 and 302 in accordance with biasing forces of the unit pressure springs 280 and 281.

Accordingly, as illustrated in FIG. 1, after passing through a contact point A at which the cooling belts 302 and 202 first contact each other to a contact point B at which the cooling rollers 201 and 301 contact each other, the cooling belts 302 and 202 contact each other over a contact point C, at which separation is started, in the entire area (denoted by a thick line). Accordingly, when a sheet P is conveyed, the sheet P is conveyed in a frictional manner with the front surface and the rear surface of the sheet P being brought into surface contact with the cooling belts 302 and 202. The heat of the sheet P is transferred to the cooling belts 302 and 202 in accordance with the surface contact and is radiated through the cooling rollers 201 and 301.

In addition, the cooling rollers 201 and 301 that suspend the cooling belts 202 and 302 press each other, and a conveying path that is a sheet conveying path is bent in the shape of "S" so as to be arranged as denoted by a thick line in FIG. 1. More specifically, the belt pressure rollers 205 and 204 are arranged to contact the cooling belt 202 on the circumferential face of the cooling roller 301, and the belt pressure rollers 303 and 304 are arranged to contact the cooling belt 302 on the circumferential face of the cooling roller 201. From this, conveying paths bent in the shape of "S" that contact the cooling belts 202 and 302 from the circumferential face of the cooling roller 301 along the circumferential face of the cooling roller 201 can be formed. In addition, the cooling conveying paths bent in the shape of "S" is configured to have a path length that approximately matches a maximum length of a sheet that can be used by the image forming apparatus 500. From this, the sheet P can be conveyed by the cooling belts 202 and 302 while the sheet P is brought into surface contact with the cooling belts 202 and 302 and the cooling rollers 201 and 301 over the entire area of the conveying paths. Accordingly, the cooling efficiency for the sheet can be markedly improved, and the productivity of the image forming apparatus can be improved.

The cooling rollers 201 and 301 are formed from members (here, aluminum members) having a high heat radiation effect and, as illustrated in FIGS. 1, 7A, and 7B, have hollow inner portions. In addition, in the cooling rollers 201 and 301, a plurality of heat radiation fins 201*a* and 301*a* having a protruded shape is formed on the inner walls having hollow inner portions. The plurality of heat radiation fins 201*a* and 301*a* is formed in a spiral shape in the direction of the rotation shafts of the cooling rollers 201 and 301. From this, the surface area of each one of the cooling rollers 201 and 301 is larger than that of the pipe-shape of the hollow inner wall, and accordingly, the heat radiation effect is high.

In addition, in the spaces of the hollow inner portions of the cooling rollers 201 and 301, as illustrated in FIGS. 7A and 7B, cooling air is caused to flow by the cooling fans 290 and 390, whereby the radiation of heat to the outside the cooling apparatus 101 is promoted.

Furthermore, the spiral shaped heat radiation fins 201*a* and 301*a* cause cooling air to be generated inside in accordance with the rotation of the cooling rollers 201 and 301. As illustrated in FIGS. 7A and 7B, the advancement directions of the spirals of the heat radiation fins 201*a* and 301*a* of the cooling rollers 201 and 301 are opposite to each other with respect to the shaft directions. Accordingly, although the rotation directions of the cooling rollers 201 and 301 are different from each other, the wind direction of cooling air generated by the heat radiation fins 201*a* and 301*a* following the rotation of the cooling rollers 201 and 301 coincides with the wind direction of the cooling air of the cooling fans 290 and 390. As a result, the cooling airs generated by the cooling fans 290 and 390 flow without blocking each other.

The cooling roller 201 rotates in the counterclockwise direction as illustrated in FIG. 1 as the cooling roller driving gear 201G fixed to one end side thereof receives a driving transfer from the driving input gear 292 provided with a driving force from a driving motor that is a driving source not illustrated in the figure. From this, the cooling belt 202 is frictionally driven in the direction of an arrow illustrated in FIG. 1, and the belt pressure rollers 204 and 205 and the tension roller 203 are also driven to rotate. In addition, the cooling belt 302 is driven and conveyed in a direction of the arrow illustrated in FIG. 1 in accordance with the frictional driving from the cooling belt 202, whereby the belt pressure rollers 303 and 304 and the tension roller 305 are driven to rotate.

A path length from the contact point A to the contact point C that is a conveying path illustrated in FIG. 1 formed by the cooling rollers 201 and 301 is configured to approximately coincide with a length of a sheet P having a maximum length (for example, a sheet of the A3 size) that can be used in the image forming apparatus 500 using the sheet cooling apparatus. From this, the cooling efficiency for the sheet P can be maximally maintained without inhibiting the miniaturization of the whole device. For example, since the A3 size is 297 mm×420 mm, the path length from the contact point A to the contact point C is preferably set to about 400 mm to 450 mm.

An experiment relating to sheet cooling was performed by the inventors of the invention under the condition that the set temperature of the surface layer of the fixing roller 110 was 180° C., the set temperature of the surface layer of the pressure roller 111 was 100° C., the ambient temperature was 23° C., and the ambient humidity was 50%. As an example of a specific experiment, under this condition, an experiment was performed in which a sheet P that was plain paper having a basis weight of about 70 to 80 g and an internal moisture content of about 6% is conveyed at an conveying speed of about 300 to 500 mm/sec. Then, an experiment result was acquired in which the sheet P right after passing through the fixing nip N was heated to a surface temperature of about 90° C., and the internal moisture content decreased to about 4%.

At this time, the sheet P heated and pressed inside the fixing nip portion N receives heat more from the fixing roller 110 having high temperature than from the pressure roller 111, and fibers grow more on the upper face side of the sheet P that is the fixing roller 110 side than on the lower face side of the sheet P that is the pressure roller 111 side. From this, consequently, a curl formed in the lower direction (hereinafter, referred to as a downward curl) occurs in the sheet P. In addition, the moisture content near the end portion of the sheet P in the width direction decreases more, in which one side is not bound, and moisture movement from/to the air can easily occur, decreases more than in the center portion of the sheet P in the width direction in which the periphery is restrained by the fiber structure. Accordingly, since the fibers of the sheet P can easily grow, and, consequently, a phenomenon (hereinafter, referred to as a ripple) occurs in which the surface of the end portion of the sheet P is deformed in a shape having ripples in the vertical direction.

Under the above-described condition, for example, there are cases where the amount of the downward curl occurring in the front end portion and the rear end portion of the sheet P is 10 to 15 mm, and the height of the ripple in the end portion in the width direction is about 1.5 to 2 mm.

In the path from the contact point A to the contact point C (denoted by a thick line in FIG. 1) that is the cooling conveying path formed by the cooling belts 302 and 202, the sheet P, first, passes a first bending path according to the curvature of the cooling roller 301 between the contact point A and the contact point B. Then, the sheet P continuously passes a second bending path according to the curvature of the cooling roller 201 between the contact point B and the contact point C. In the cooling conveying path from the contact point A to the contact point C, since it is immediately after the start of cooling, the sheet P passes the upward first bending path according to the curvature of the cooling roller 301 between the contact point A having relatively high temperature and the contact point B. Accordingly, in the first bending path, the sheet P is more effectively corrected for the curl thereof by the curl correction effect using the downward second bending path according to the curvature of the cooling roller 201 from the contact point B, which is a latter half of the cooling process, to the contact point C.

The path length from the contact point A to the contact point C is set to about 400 mm to 450 mm as described above. In such a case, in the sheet P passing the nip portion N and further passing an area between the upper discharge guide 501 and the lower discharge guide 502, the upper face side and the lower face side are cooled to about 30° C. to 50° C. by the cooling rollers 301 and 201, respectively, from the contact point A to the contact point C that is a cooling conveying path. Simultaneously, between the contact point A and the contact point B, the sheet P is corrected for the curl upwardly in accordance with the curvature of the upward bending path according to the curvature of the cooling roller 301, and the amount of the downward curl occurring in the front end portion and the rear end portion of the sheet P is enhanced to be 0 to 5 mm.

In addition, an abrupt decrease in the amount of moisture can be prevented by cooling the sheet P, and, as a result, the amount of moisture inside the sheet is enhanced to about 4.5 to 5%, and the height of the ripple in the end portion of the sheet in the width direction can be enhanced to about 0.5 to 0.8 mm.

Figure 8:
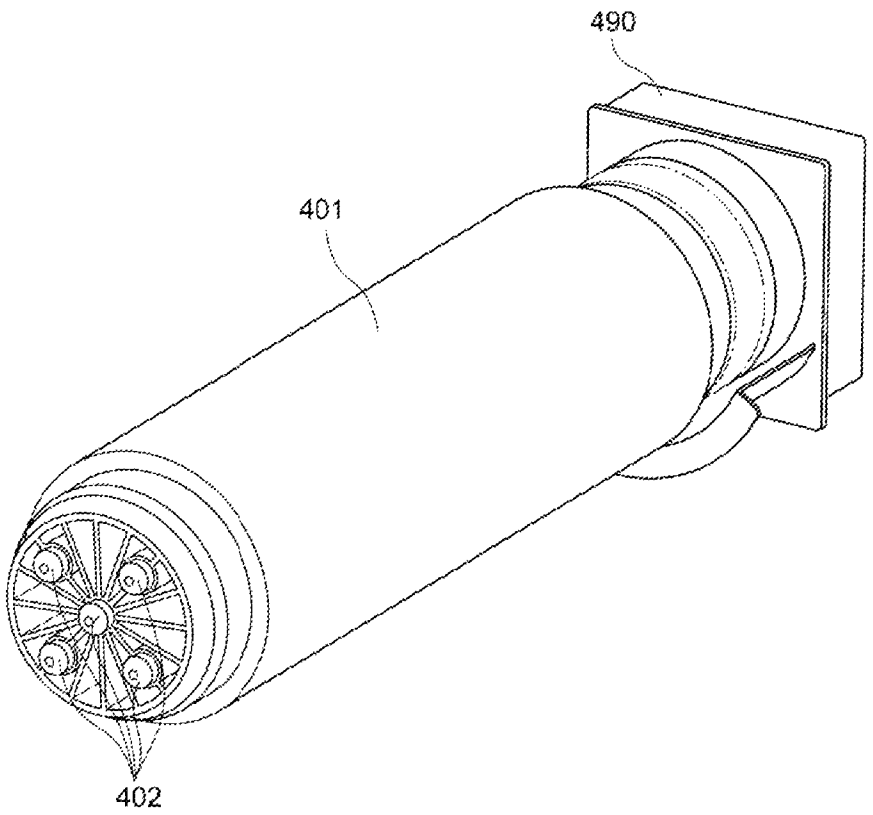
FIG. 8 is an external view that illustrates a cooling roller according to the first embodiment.
Figure 9:
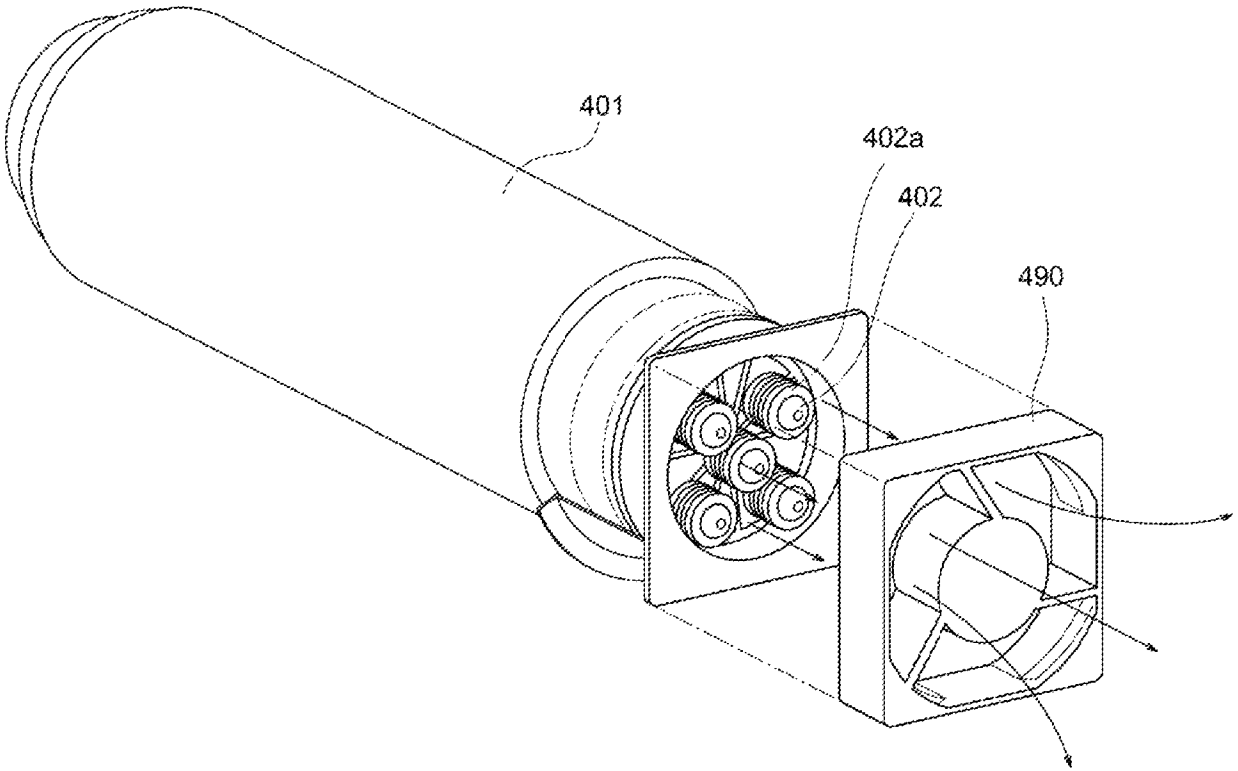
FIG. 9 is an external view that illustrates the cooling roller according to the first embodiment.

Here, each one of the cooling rollers 201 and 301 may be a cooling roller 401 having the configuration illustrated in FIGS. 8 and 9.

In FIGS. 8 and 9, a heat pipe 402 is a thermal uniformization member and is disposed inside the cooling roller 401. As illustrated in FIG. 9, heat radiation fins 402*a* formed from a material such as aluminum or stainless steel having relatively high heat transference are fixed to one end portion of the heat pipe 402.

Inside the cooling roller 401, a hollow portion used for causing cooling air to flow using the cooling fan 490 is formed, and a plurality of the heat pipes 402 holds the heat radiation fins 402*a* toward the cooling fan 490 side. As above, by arranging the heat pipes that are thermal uniformization members inside the cooling roller 401, for example, even in the case of continuous conveying sheets of the A4 size in the vertical direction, a temperature difference between the inside of the conveying area in the width direction of the cooling roller 401 and the outside of the area can decrease as much as possible. Accordingly, an advantage that it is further difficult to spoil the cooling performance can be expected.

Figure 10:
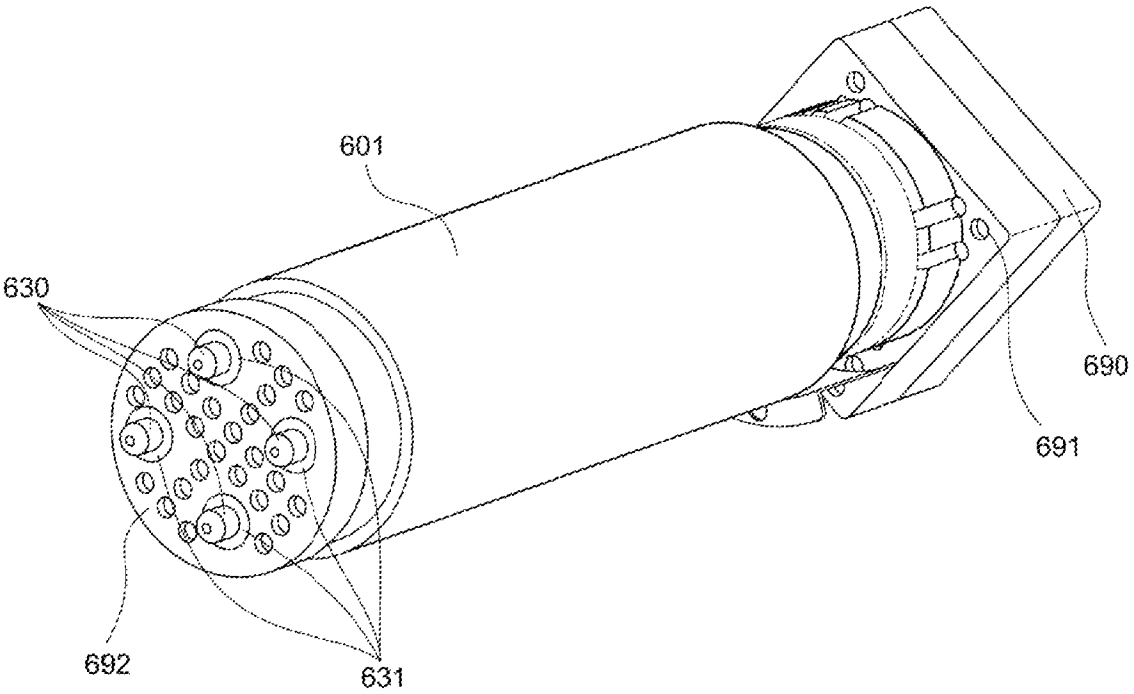
FIG. 10 is an external view that illustrates the cooling roller according to the first embodiment.
Figure 11:
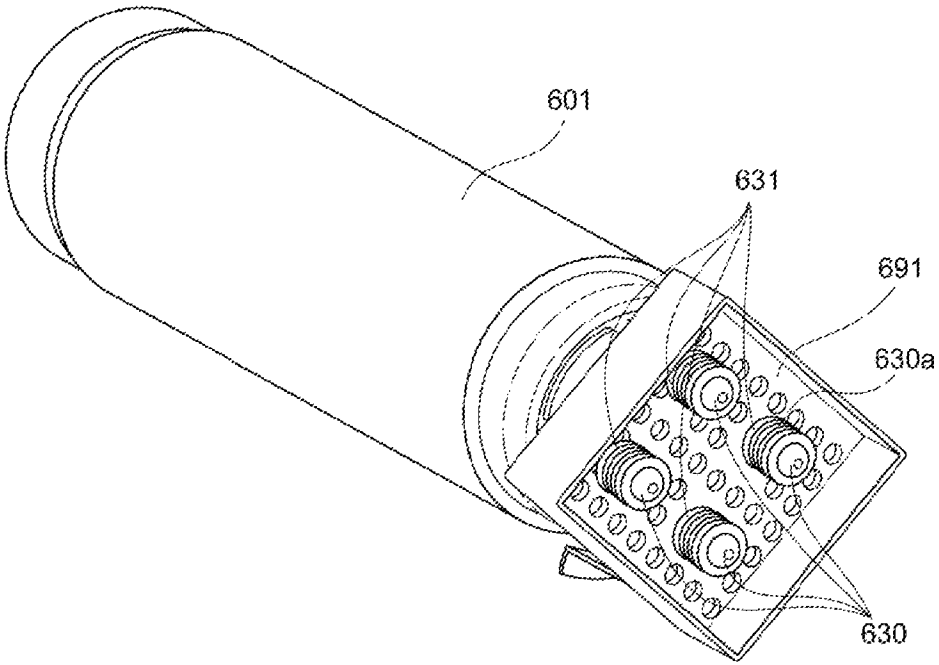
FIG. 11 is an external view that illustrates the cooling roller according to the first embodiment.
Figure 12:
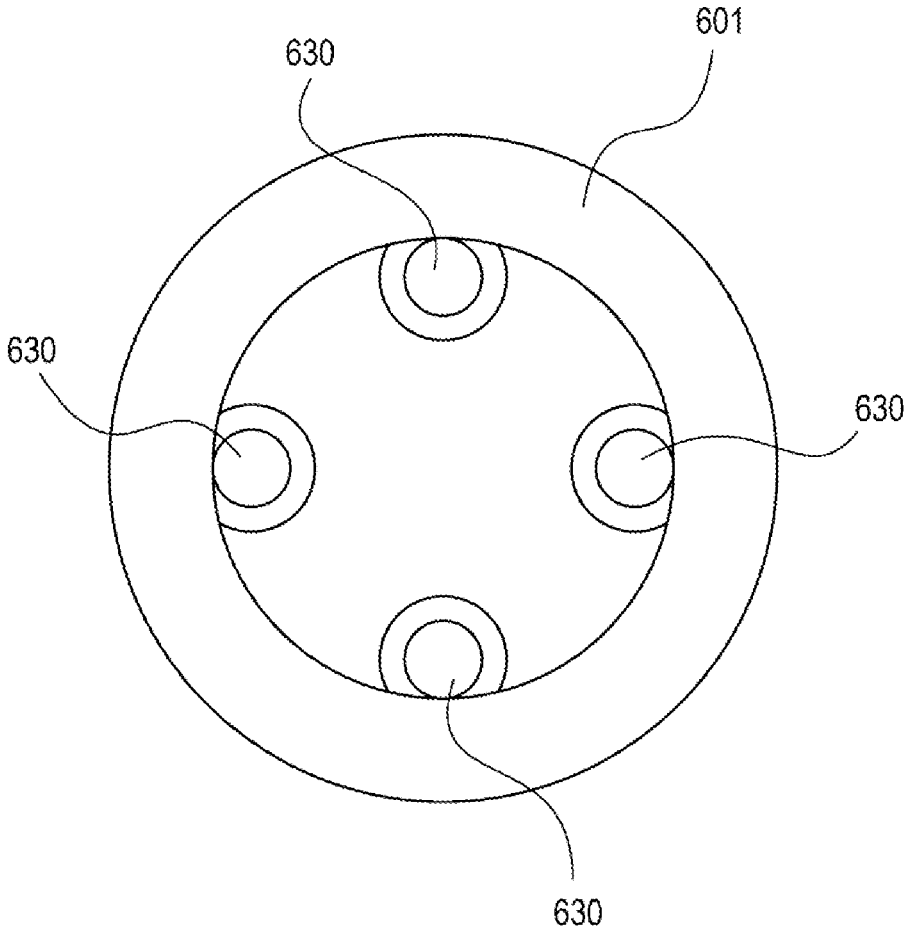
FIG. 12 is a cross-sectional view that illustrates the cooling roller according to the first embodiment.

Other than the above-described configuration, for example, a cooling roller 601 having the configuration as illustrated in FIGS. 10, 11, and 12 may be used.

As illustrated in FIGS. 10, 11, and 12, a plurality of heat pipe rollers 630 is acquired by coating the surface layers of the heat pipes, which are thermal uniformization members, with a PFA heat-resistant toner parting layer and are disposed inside the cooling roller 601. As illustrated in FIG. 11, heat radiation fins 630*a* formed from a material such as aluminum or stainless steel having relatively high heat transference are fixed to one end portion of the heat pipe roller 630.

Both end portions of the heat pipe roller 630, as illustrated in FIGS. 10 and 11, are supported to be rotatable by the cooling ducts 691 and 692 through a bearing 631 such that the heat radiation fin 630*a* faces the cooling fan 690 side. A plurality of duct holes is formed on the side faces of the cooling ducts 691 and 692.

As illustrated in FIG. 12, the heat pipe roller 630 is arranged to be inscribed in the inner wall of the cooling roller 601 having the inside that is hollow in the shape of a circle. Accordingly, when the cooling roller 601 rotates, each heat pipe roller 630 is driven to rotate in accordance with friction with the inner wall face of the cooling roller 601. Even in such a case, the same advantage can be acquired by using the cooling roller 401.

As described above, by forming a heat sink structure and using the cooling rollers 201 and 301 that can rotate together with the conveying of the cooling belts 202 and 302, the conveying resistance due to the friction with the cooling belts 202 and 302 can be markedly smaller than that of the fixing type. Accordingly, the cooling belts 202 and 302 and the sheet P can be stably conveyed, whereby the driving load and the power can be reduced.

In addition, the deterioration of the durability such as abrasion of the surfaces of the cooling rollers 201 and 301 due to sliding with the cooling belts 202 and 302 does hardly occurs, thereby heat transference between the surface of members such as the cooling rollers 201 and 301 and the cooling belts 202 and 302 is stabilized. Accordingly, the cooling performance and the reliability of the durability of the sheet cooling apparatus can be markedly improved.

As a result, for example, it is not particularly necessary to perform a surface treatment such as an alumite treatment for the surfaces of the cooling rollers 201 and 301, which are formed from aluminum, so as to reduce the abrasion and deterioration. In addition, similarly, it is not particularly necessary to perform a surface treatment having low frictional resistance using a fluororesin system or the like for the surfaces of the cooling rollers 201 and 301 so as to reduce the sliding resistance and the abrasion and deterioration. Accordingly, the heat transference between the surface of members such as the cooling rollers 201 and 301 and the cooling belts 202 and 302 is not degraded, and the component cost does not increase. Therefore, for example, it is possible to revive good heat radiation/cooling capability of an aluminum material or the like. In addition, there hardly is a decrease in the strength due to the progress of the abrasion/degradation of the surfaces of the cooling belts 202 and 302, and, for example, even in a case where a polyimide material is used, the thickness can be decreased, whereby the heat transference with the cooling rollers 201 and 301 can be improved.

In addition, as described above, by pressing the cooling rollers 201 and 301 that suspend the cooling belts 202 and 302 and pressing the cooling rollers 201 and 301 to opposing cooling rollers using the belt pressure roller, the shape of the conveying path is arranged to be bent in the shape of "S" as denoted by a thick line in FIG. 1. In addition, the cooling conveying path bent in the shape of "S" is configured to have a path length that approximately coincides with a maximum length of a sheet that can be used in the image forming apparatus 500. Accordingly, the sheet P can be conveyed by the cooling belts 202 and 302 while the cooling belts 202 and 302 and the cooling rollers 201 and 301 rollers and the sheet P are brought into surface contact with each other over the entire area of the conveying path. Therefore, the cooling efficiency for a sheet can be markedly improved, and the productivity of the image forming apparatus can be improved.

Furthermore, by using a curved path bent in the shape of "S" other than a cooling conveying path having an approximately linear shape, the miniaturization of the whole apparatus can be achieved, and the curl and the ripple can be reduced by acquiring a curl correction effect for the sheet.

Second Embodiment

A cooling apparatus 102 as a sheet cooling apparatus will be described with reference to FIGS. 13A to 20. Description of the same portion as that of the above-described first embodiment will not be presented.

A cooling belt 702 as a second endless belt used for performing frictional conveying while being brought into contact with the rear face of the sheet P, a cooling roller 701, and belt pressure rollers 704 and 705 as second suspension members, and a tension roller 703 configure an independent cooling belt unit 700. The configuration of the cooling belt unit 700 is the same as that of the cooling belt unit 200 according to the above-described first embodiment, and thus, description thereof will not be presented.

Figure 13B:
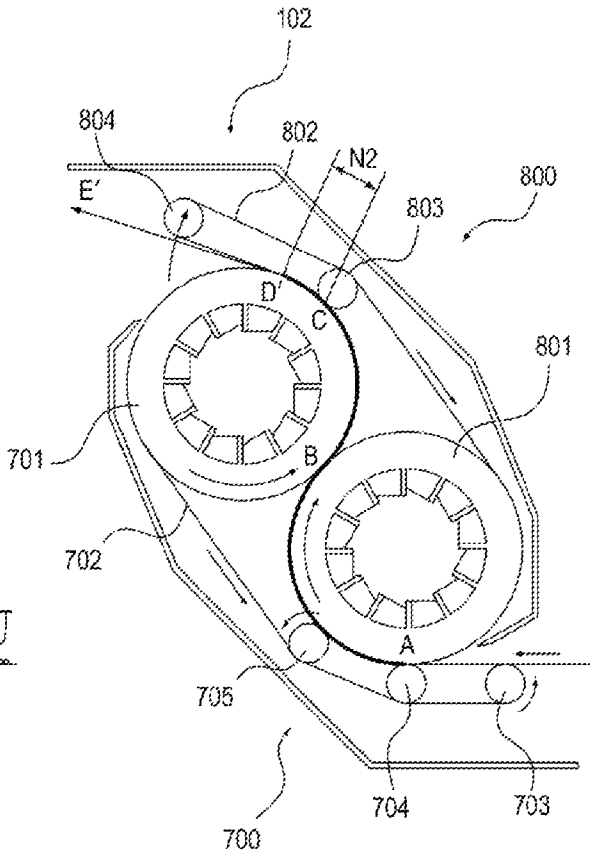
FIGS. 13A and 13B are cross-sectional views that illustrate a sheet cooling apparatus according to a second embodiment.
Figure 13A:
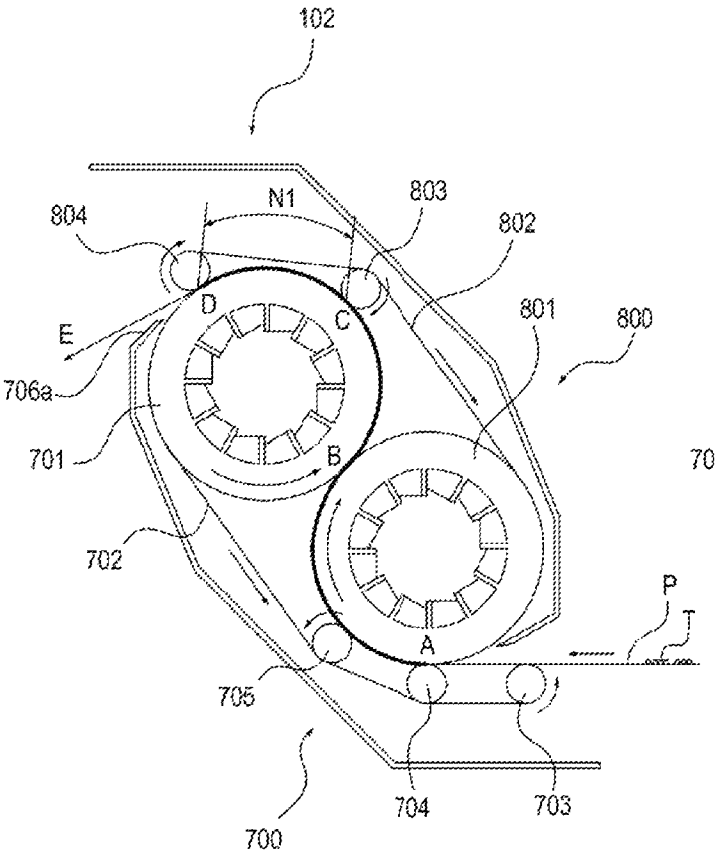

A cooling belt 802 as a first endless belt performs frictional conveyance while being brought into contact with the front surface of the sheet P. This cooling belt 802, as illustrated in FIGS. 13A and 13B, is stretched over the outer circumferences of a cooling roller 801 as a first cooling roller and belt pressure roller 803 and a tension roller 804 as first suspension members. Tension is applied to the cooling belt 802 by the tension roller 804. The cooling belt 802, the cooling roller 801, the belt pressure roller 803, and the tension roller 804 configure an independent cooling belt unit 800.

The configuration of the cooling roller 801 is the same as that of the cooling roller 301 according to the first embodiment illustrated in FIGS. 7A and 7B, and a method for supporting the cooling roller 801 toward a front side plate 810 and a rear side plate 820 configuring the frame of the cooling belt unit 800 is the same as that of the first embodiment.

The belt pressure roller 803, as illustrated in FIGS. 14, 15, 16, and 17, is supported to be rotatable through bearings 813 and 823 by pressure arms 812 and 822. In addition, the pressure arms 812 and 822 are supported to be swingable by pressure arm supporting shafts 810*b* and 820*b* formed integrally with the side faces of the front side plate 810 and the rear side plate 820.

Between pressure spring bearing faces 810*c* and 820*c* integrally formed on the outer faces of the front side plate 810 and the rear side plate 820 and the pressure arms 812 and 822, pressure springs 814 and 824 of the compression coil type are inserted, and the pressure springs 814 and 824 bias the pressure arms 812 and 822 in a direction pushing them down. Accordingly, the belt pressure roller 803 supported by the pressure arms 812 and 822 is pressed to the opposing cooling roller 701 through the cooling belts 802 and 702.

Figure 14:
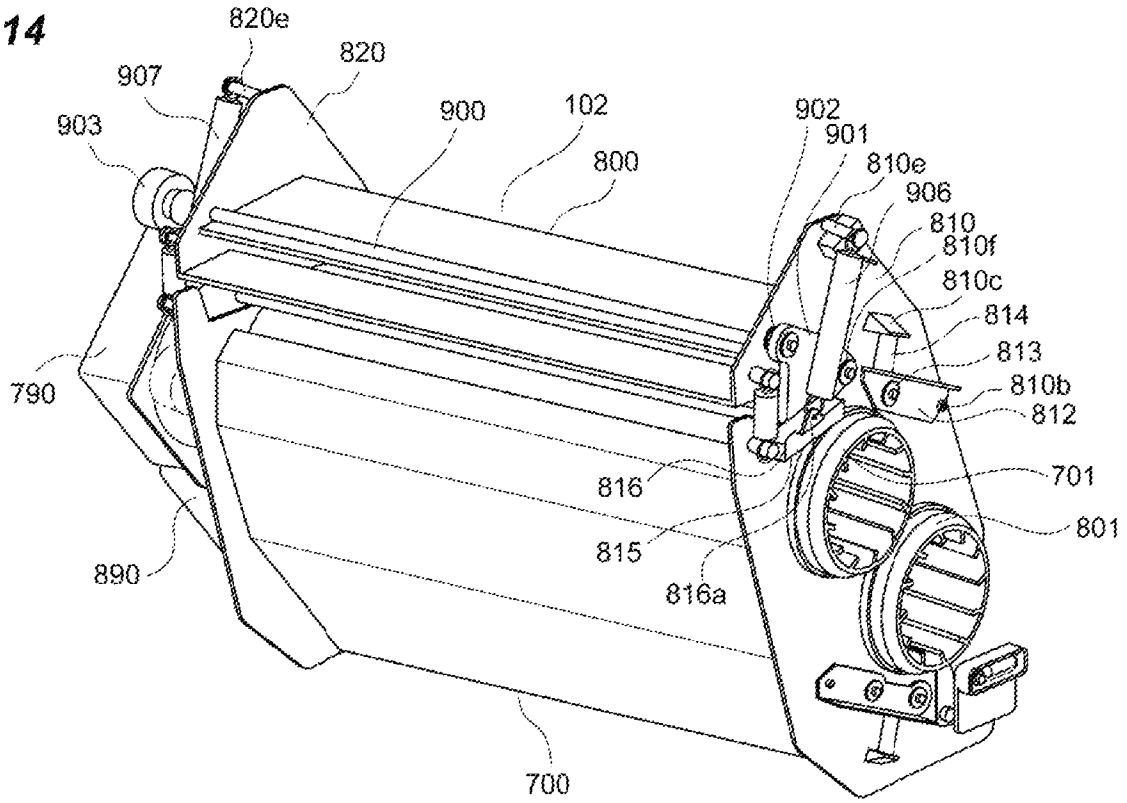
FIG. 14 is an external view that illustrates a sheet cooling apparatus according to the second embodiment.
Figure 17:
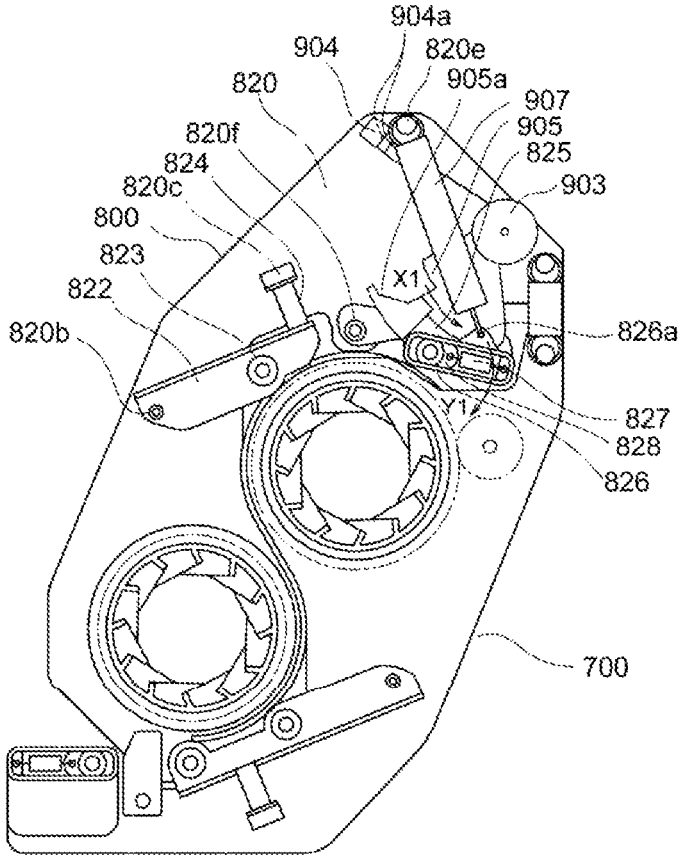
FIG. 17 is a side view that illustrates the sheet cooling apparatus according to the second embodiment.

On the outer faces of the front side plate 810 and the rear side plate 820, belt tensioners 815 and 825 used for applying tension to the cooling belt 802 are arranged. The belt tensioner 825 disposed on one side, as illustrated in FIG. 17, is arranged on the outer face of the rear side plate 820. The belt tensioner 815 on a side opposite thereto is arranged so as have a shape symmetrical to the belt tensioner 825 of the rear side plate 820 on the outer face of the front side plate 810 as illustrated in FIG. 14. The belt tensioners 815 and 825 have a configuration in which tension roller bearings, of which roller bearing 828 of belt tensioner 825 is shown in FIG. 17 and a corresponding roller bearing of belt tensioner 815 is not shown in the figures, support both end portions of the tension roller 804 to be rotatable are supported by hollow inner walls of tensioner holders 816 and 826 having hollow inner portions in the shape of a rectangle so as to be slidable. In addition, one of the ends of tension springs of the pulling coil type, of which tension spring 827 of belt tensioner 825 is shown in FIG. 17 and a corresponding tension spring of belt tensioner 815 is not shown in the figures, is hooked into respective hollow inner walls of the tensioner holders 816 and 826 and the other ends of the tension springs are hooked into respective tension roller bearings. As the tension roller bearings are pulled and biased, the tension roller 804 applies tension to the cooling belt 802 while being supported to be rotatable.

Figure 16:
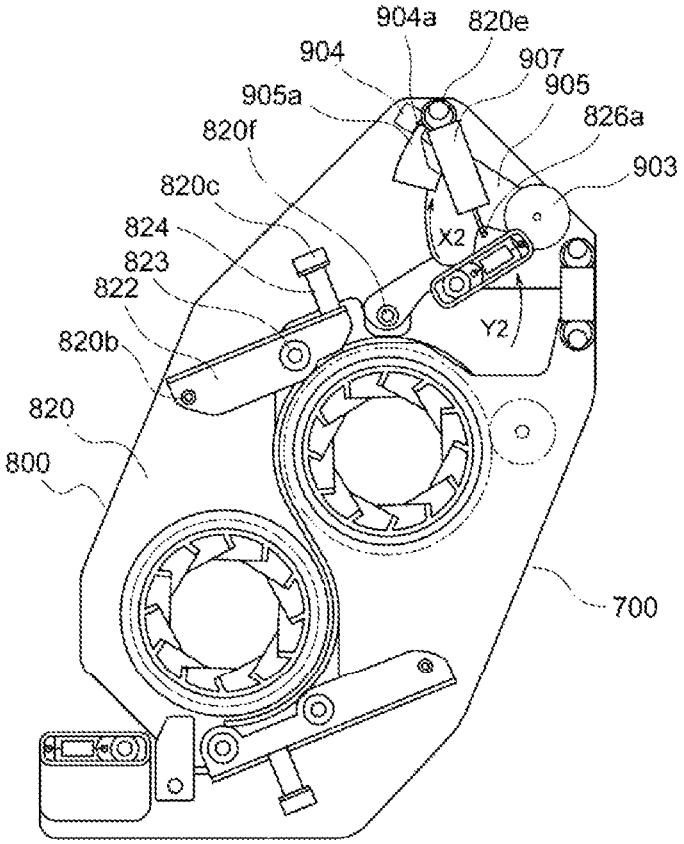
FIG. 16 is a side view that illustrates the sheet cooling apparatus according to the second embodiment.

In addition, on the outer faces of the front side plate 810 and the rear side plate 820, tensioner holder supporting shafts 810*f* and 820*f* used for supporting the tensioner holders 816 and 826 to be swingable in directions Y1 and Y2 of arrows illustrated in FIGS. 16 and 17 are integrally formed. The tensioner holders 816 and 826 can swing with respect to the tensioner holder supporting shafts 810*f* and 820*f* as the centers thereof. Accordingly, the tension roller 804 supported through the tension roller bearings 818 and 828 can reciprocate from a position contacting the cooling roller 701 illustrated in FIG. 13A to a position separated from the cooling roller 701 illustrated in FIG. 13B.

In other words, among a plurality of suspension members for suspending the cooling belt 802, the tension roller 804 located on the downstream in the conveying direction of the sheet is disposed to be movable so as to approach or be separated from the opposing cooling roller 701. In addition, by moving the tension roller 804, the nip length in the lowermost-stream portion in the contact range with the cooling belts 802 and 702 can be arbitrarily changed. This will be described more specifically.

Figure 15:
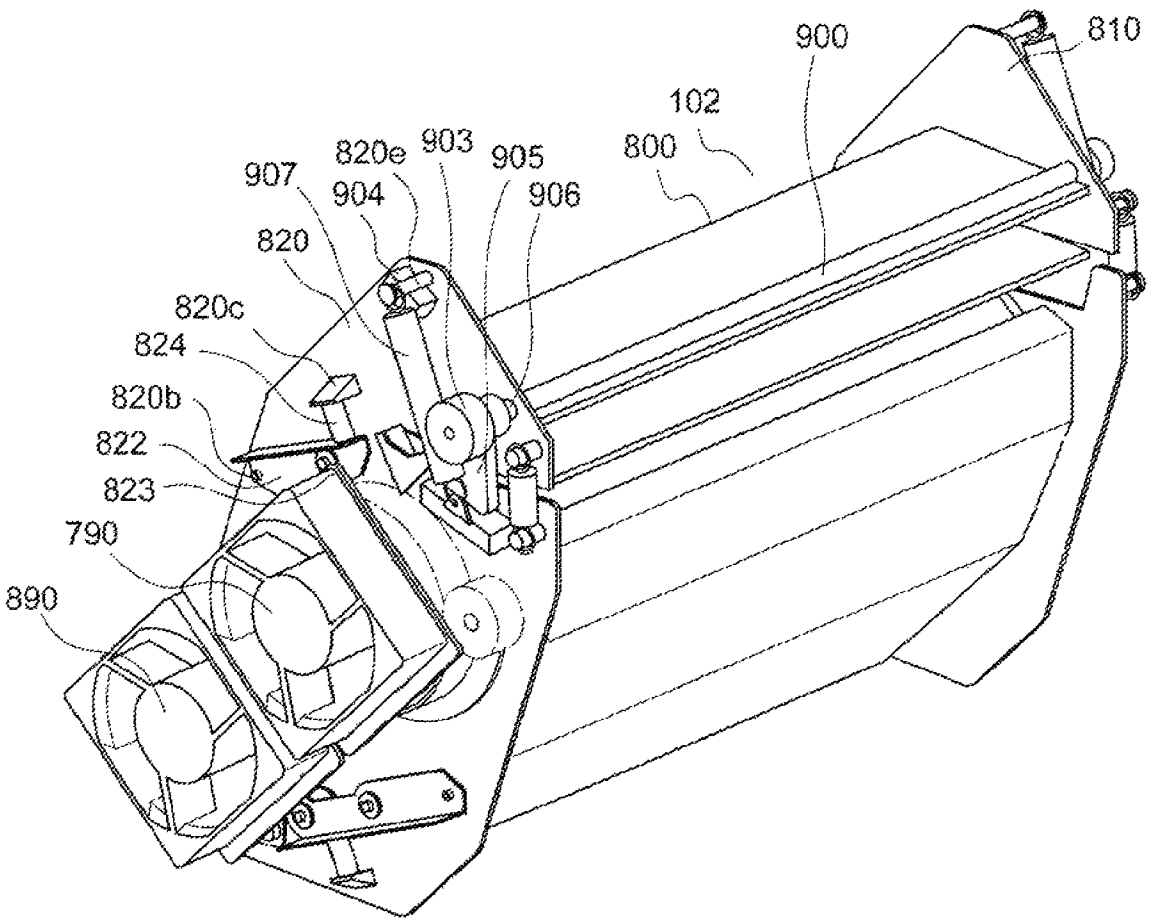
FIG. 15 is an external view that illustrates the sheet cooling apparatus according to the second embodiment.

As illustrated in FIGS. 14 and 15, near both end portions of a cam shaft 900 supported to be rotatable through bearings 902 and 906 by the front side plate 810 and the rear side plate 820, on the outer side of the front side plate 810 and the rear side plate 820, cams 901 and 905 having the same shape are fixed with the same phase. In addition, on the outer side of the cam 905, a cam driving motor 903 using a pulse motor used for driving the cam shaft 900 to rotate is arranged on the outer side of the rear side plate 820. Accordingly, the cams 901 and 905 can swing in the directions of arrows X1 and X2 illustrated in FIGS. 16 and 17 in accordance with the rotation of the cam shaft 900.

As illustrated in FIG. 15, above the cam 905 disposed on the outer face of the rear side plate 820, a cam sensor 904 used for detecting an angular position of the cam 905 is arranged.

When the cam driving motor 903 starts to rotate in the direction (clockwise direction) of an arrow X2 illustrated in FIG. 17, the cams 901 and 905 fixed to the cam shaft 900 rotate in the same direction. A detection flag portion 905*a* formed integrally with one end of the cam 905, as illustrated in FIG. 17, arrives between detection slits 904*a* of the cam sensor 904, it is detected that the cams 901 and 905 are located at an upper limit position illustrated in FIG. 16.

On the outer faces of the front side plate 810 and the rear side plate 820, spring hook pins 810*e* and 820*e* are integrally formed. On one ends of the tensioner holders 816 and 826, spring hook holes 816*a* and 826*a* are integrally formed. Pushing-up springs 906 and 907 of the pulling type can are hooked between the spring hook pins 810*e* and 820*e* and the spring hook holes 816*a* and 826*a*, and the tensioner holders 816 and 826 are biased so as to be pushed upwardly. Accordingly, the upper surfaces of the tensioner holders 816 and 826 contact the arc faces of the cams 901 and 905, as illustrated in FIGS. 16 and 17, in accordance with biasing forces of the pushing-up springs 906 and 907.

According to the configuration described above, the vertical positions of the tensioner holders 816 and 826 and the tension roller 804 supported to be rotatable by the tensioner holders 816 and 826 are controlled to be changed through the cams 901 and 905 by driving the cam driving motor 903 to rotate. The flow of control for lifting the tension roller 804 is illustrated in FIG. 18.

Figure 18:
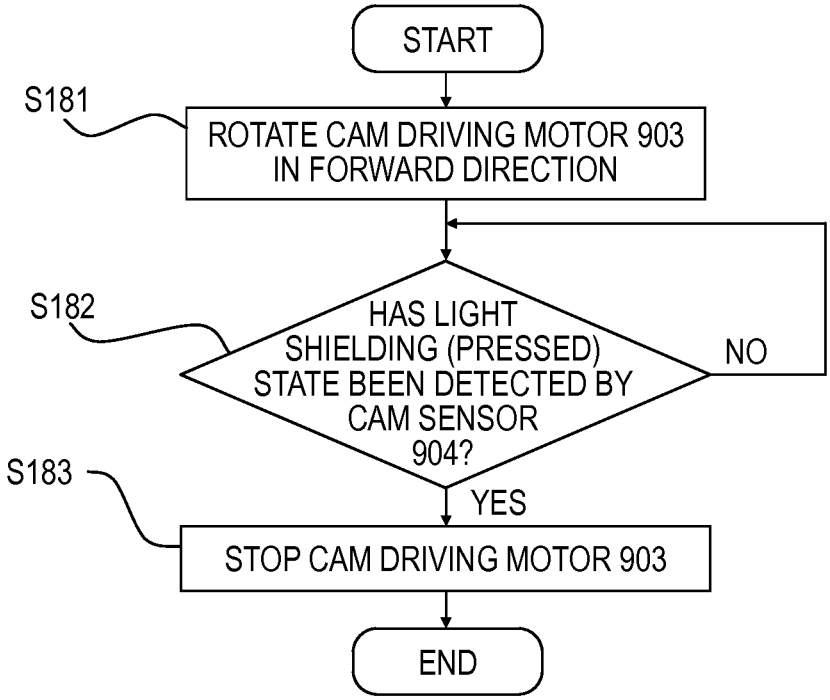
FIG. 18 is a flowchart that illustrates a cooling nip switching operation according to the second embodiment.

As illustrated in FIG. 13A, when the cam driving motor 903 starts to rotate from a position at which the tension roller 804 contacts the cooling roller 701 in the direction of arrow X2 (clockwise direction) in FIG. 16 in S181 illustrated in FIG. 18, the cam faces of the cams 901 and 905 rise. In accordance therewith, the tensioner holders 816 and 826 rise in accordance with biasing forces of the pushing-up springs 906 and 907. Accordingly, the tension roller 804 supported to be rotatable by the tensioner holders 816 and 826 rise in the direction of arrow Y2 illustrated in FIG. 16 with respect to the tensioner holder supporting shafts 810*f* and 820*f* as the centers thereof. Then, when the cam 905 is detected by the cam sensor 904 in S182, the cam driving motor 903 stops in S183. At this time, the tension roller 804 arrives at the upper limit position.

Figure 19:
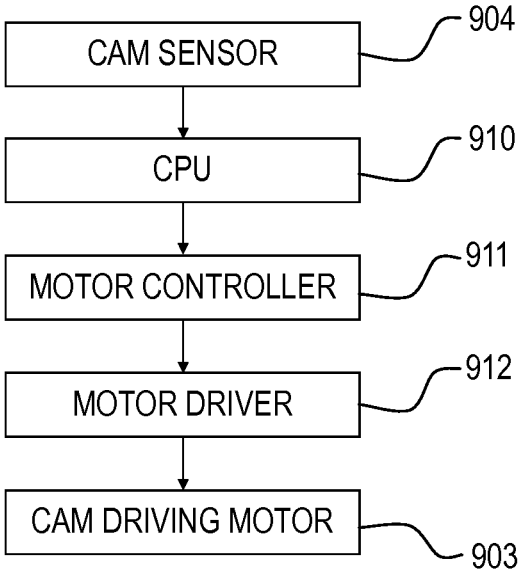
FIG. 19 is a block diagram that illustrates a controller controlling the cooling nip switching operation according to the second embodiment.

The state in which the tension roller 804 arrives at the upper limit position is illustrated in FIGS. 13B and 16. In addition, a block diagram of the sheet cooling apparatus according to this embodiment is illustrated in FIG. 19. As illustrated in FIG. 19, a CPU 910 as a controller controls the operation of the cam driving motor 903 through a motor controller 911 and a motor driver 912 in accordance with a signal transmitted from the cam sensor 904.

As illustrated in FIG. 13B, the cooling belts 702 and 802 start contacting from the contact point A and passes the contact point B of the cooling rollers 701 and 801 and the contact point C between the belt pressure roller 803 and the cooling roller 701, and thereafter, the cooling belts 702 and 802 are separated away from each other at a final contact point D'. At this time, the sheet P is discharged in the direction of arrow E'. A nip length from the contact point C contacting the belt pressure roller 803 to the final contact point D' is N2.

For example, there is a case where a photograph image or the like for which the amount of toner T get onto the upper surface of the sheet P is much more than that of the case of a text image or the like for which the amount of toner is small is fixed to thin paper, particularly having low mass and low strength. In such a case, the adhesion between the toner T and the surface layer of the fixing roller 110 is firm inside the fixing nip portion N, and there is a case where an upward curl that is opposite to a downward curl occurs until the sheet is detached from the surface layer of the fixing roller 110.

In addition, a cardboard or a coated sheet that receives more heat from the fixing device 100 than general plain paper having a weight of the sheet P of about 70 g to 80 g can easily maintain high temperature even after passing through the fixing device 100. In addition, even when the weights of the sheets are equivalent, and the temperatures of sheets P after passing through the fixing device 100 are equivalent, a sheet having low rigidity has internal moisture that can be easily extracted to the outside, and a ripple tends to be remarkable therein.

As above, the contact range of the cooling belts 702 and 802 illustrated in FIG. 13B, that is, in the process of cooling the sheet P from the contact point A to the contact point D', there is a case where the cooling performance for the sheet P is not sufficient, or the applying of a downward curl to the sheet P is not sufficient. In such a case, as below, the location of the tension roller 804 is lowered toward the cooling roller 701. The flow of control for lowering the tension roller 804 is illustrated in FIG. 20.

Figure 20:
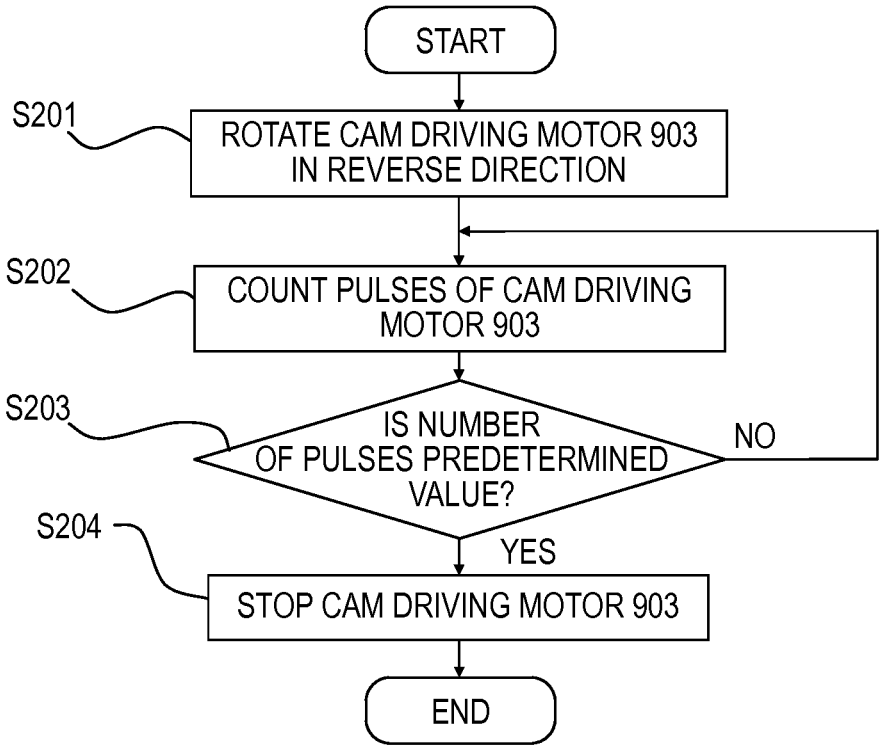
FIG. 20 is a flowchart that illustrates the cooling nip switching operation according to the second embodiment.

When the cam driving motor 903 starts to rotate in a direction (the direction of arrow X1 illustrated in FIG. 17) opposite to the direction of arrow X2 in FIG. 16, in other words, in the counterclockwise direction in S201 illustrated in FIG. 20, the cam faces of the cams 901 and 905 fall. In accordance therewith, the tensioner holders 816 and 826 and the tension roller 804 starts to fall in resistance against the biasing forces of the pushing-up springs 906 and 907 in the direction of arrow X1 illustrated in FIG. 17 with respect to the tensioner holder supporting shafts 810*f* and 820*f* as the centers thereof. Input pulses input to the cam driving motor 903 are started to be counted in S202, and, when the number of input pulses arrives at an arbitrary predetermined value in S203, the rotation of the cam driving motor 903 is stopped in S204. In a case where the predetermined value of the number of input pulses input to the cam driving motor 903 is set to a maximum value, as illustrated in FIG. 13A, the tension roller 804 contacts the cooling roller 701 through the cooling belts 702 and 802.

At this time, as illustrated in FIG. 13A, the cooling belts 702 and 802 start contacting from the contact point A, and the cooling belts 702 and 802 are brought into surface contact with each other in a path (denoted by a thick line) up to the contact point D between the tension roller 804 and the cooling roller 701. At this time, the sheet P is discharged in the direction of arrow E. A nip length from the contact point C with the belt pressure roller 803 to the final contact point D is N1. This nip length N1, as is apparent in FIGS. 13A and 13B, is longer than the above-described nip length N2 up to the contact point D'.

As above, after the cooling belts 702 and 802, as illustrated in FIGS. 13A and 13B, pass from the contact point A to the contact point B at which the cooling rollers 701 and 801 contact each other, the cooling belts 702 and 802 are brought into contact with each other in the entire area of the path (denoted by a thick line) over the contact point D or D' for separation. Accordingly, when a sheet P is conveyed to the cooling apparatus, the sheet P is frictionally conveyed with the front surface and the rear surface being brought into surface contact with the cooling belts 702 and 802 along the circumferential faces of the cooling rollers 801 and 701. In accordance with the surface contact, the heat contained in the sheet P is transferred to the cooling belts 702 and 802 and is radiated through the cooling rollers 701 and 801.

Similarly to the first embodiment, the cooling rollers 701 and 801 have hollow inner portions, and a plurality of heat radiation fins is formed in a hollow inner wall in the shape of a spiral so as to have a surface area larger than that of the pipe shape. As a result, the heat radiation effect is high.

In addition, by causing cooling air to flow in the hollow inner spaces of the cooling rollers 701 and 801 in accordance with the cooling fans 790 and 890, the heat radiation to the outside of the cooling apparatus 102 is promoted, which is the same as the first embodiment.

Furthermore, the advancement directions of the spirals of the heat radiation fins of the cooling rollers 701 and 801, as illustrated in FIGS. 7A and 7B, are opposite to each other. Accordingly, although the rotation directions of the cooling rollers 701 and 801 are different from each other, the wind direction of cooling air generated by the heat radiation fins 20 coincides with the wind direction of the cooling air generated by the cooling fans 790 and 890. As a result, the cooling air generated by the cooling fans 790 and 890 flow without blocking each other, which is the same as the first embodiment.

According to the configuration and the operation of the sheet cooling apparatus 102 described as above, in addition to the advantages of the above-described embodiments, the following advantages can be acquired. According to this embodiment, a nip length from the contact point C with the belt pressure roller 803 to the final the contact point D or D' in the lowermost-stream portion of the contact range with the cooling belts 702 and 802 can be arbitrary selected (changed) in the range from an upper limit N1 to a lower limit N2. Accordingly, the correction for the ripple and the curl that is optimal in accordance with the weight, the size, the paper type, the installation environment, the fixing temperature, and the like of the sheet P can be performed.

In the above-described embodiment, while the printer has been described as an image forming apparatus as an example, the present invention is not limited thereto. For example, the image forming apparatus may be another image forming apparatus such as a copying machine or a facsimile apparatus or another image forming apparatus such as a multi-function apparatus combining the functions thereof. In addition, the image forming apparatus is not limited to an image forming apparatus in which an intermediate transfer member is used, and toner images carried in the intermediate transfer member are transferred to a sheet together. Thus, the image forming apparatus may be an image forming apparatus in which a sheet bearing member is used, and toner images of colors are sequentially transferred to a sheet carried in the sheet bearing member in an overlapping manner. By applying the present invention to a sheet cooling apparatus of such an image forming apparatus, the same advantages can be acquired.

In addition, in the above-described embodiment, while the first and second cooling rollers, the first and second endless belts, and the first and second suspension members have been described to respectively have the same configuration and the same material, the present invention is not limited thereto. For example, in order to correct the curl of the sheet, it may be configured such that one cooling roller has a hollow inner portion and has a plurality of the heat radiation fins formed on the hollow inner wall in the shape of a spiral, and the other cooling roller is formed as a solid metal bar having a diameter smaller than the diameter of the one cooling roller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-166069, filed Jul. 26, 2012, which is hereby incorporated by reference herein in its entirety.

What is claimed is:

1. A sheet cooling apparatus that cools a sheet while conveying the sheet passed through a fixing device for fixing an unfixed toner image formed on the sheet by heating the toner image, the sheet cooling apparatus comprising:

a first cooling roller that is hollow inside;

a first suspension roller arranged downstream of the first cooling roller in a conveying direction;

a first endless belt that is suspended on the first cooling roller and the first suspension roller;

a second cooling roller that is hollow inside and arranged downstream of the first cooling roller in the conveying direction;

a second suspension roller arranged upstream of the second cooling roller in the conveying direction;

a second endless belt that is suspended on the second cooling roller and the second suspension roller;

a first cooling fan that blows cooling air into the hollow of the first cooling roller along a rotation axis of the first cooling roller in a fan blowing direction; and a second cooling fan that blows cooling air into the hollow of the second cooling roller along a rotation axis of the second cooling roller in the fan blowing direction, wherein a plurality of spiral-shaped heat radiation fins are disposed on an inner wall of the hollow inside of each of the first and second cooling rollers in the direction of the rotation axis of the first and second cooling rollers, respectively, the advancement directions of the plurality of spiral-shaped heat radiation fins of the first and second cooling rollers being opposite to each other with respect to the rotation axis direction of the first and second cooling rollers, respectively, and wherein a rotation direction of the first cooling roller is opposite to a rotation direction of the second cooling roller, whereby a fin blowing direction of the movement of the cooling air generated by the plurality of heat radiation fins of the first and second cooling rollers following rotation of the first and second cooling rollers, respectively, coincides with the fan blowing direction of the movement of the cooling air generated by the first and second cooling fans.

2. The sheet cooling apparatus according to claim 1, wherein a plurality of the first suspension rollers is disposed, and at least one of the plurality of the first suspension rollers is pressed to the second cooling roller through the first endless belt.

3. The sheet cooling apparatus according to claim 2, wherein a suspension roller disposed downstream in the conveying direction among the plurality of the first suspension rollers is provided to be movable so as to approach or be separated from the second cooling roller, and a nip length in a lowermost-stream portion of a contact range between the first endless belt and the second endless belt is changed in accordance with a movement of the suspension roller.

4. The sheet cooling apparatus according to claim 1, wherein a plurality of the second suspension rollers is disposed, and at least one of the plurality of the second suspension rollers is pressed to the first cooling roller through the second endless belt.

5. The sheet cooling apparatus according to claim 1, wherein at least one of the first and second cooling rollers having the hollow inside includes at least one heat pipe roller disposed in the hollow inside and supported to be rotatable for heat uniformization in the direction of the rotation axis of the first or second cooling roller.

6. The sheet cooling apparatus according to claim 5, wherein the at least one heat pipe roller contacts an inner wall of the first or second cooling roller and is driven to rotate in accordance with the rotation of the first or second cooling roller in a same direction.

7. The sheet cooling apparatus according to claim 1, wherein the sheet conveying path is bent in a shape of the letter "S".

8. The sheet cooling apparatus according to claim 1, wherein the second suspension roller is arranged so as to press the first cooling roller through the first endless belt and the second endless belt, and the first suspension roller is arranged so as to press the second cooling roller through the first endless belt and the second endless belt.

9. The sheet cooling apparatus according to claim 1, wherein the first cooling roller is arranged so as to press the second cooling roller through the first endless belt and the second endless belt.

10. The sheet cooling apparatus according to claim 1, wherein the heat radiation fins form a spiral shape formed in axial directions of rotation axes of the first and second cooling rollers so that an air flow is generated inside of the cooling roller in accordance with rotation of the cooling roller.

11. The sheet cooling apparatus according to claim 10, wherein a direction of the cooling air flow according to the rotation of the first and second cooling rollers and a direction of a cooling air flow according to the first cooling fan and the second cooling fan coincide with each other.

12. The sheet cooling apparatus according to claim 1, further comprising:

a first cooling belt unit having the first endless belt and the first suspension roller;

a second cooling belt unit having the second endless belt and the second cooling roller;

at least one shaft coupling the first and second cooling belt units at one end thereof to swingably couple the first and second cooling belt units; and at least one tensioning mechanism configured to bias the first and second cooling belt units toward each other at another end thereof.

13. The sheet cooling apparatus according to claim 12, wherein the tensioning mechanism comprises a pair of pressure springs.

14. The sheet cooling apparatus according to claim 1, further comprising:

a single driving motor configured to drive the second cooling roller, wherein the first cooling roller is driven to rotate via frictional driving contact with the second cooling roller.

15. The sheet cooling apparatus according to claim 1, wherein the first and second endless belts contact each other at an initial contact point and at a final contact point downstream of the initial contact point to define a length of a path for conveyance of the sheet from the initial contact point to the final contact point, wherein the length of the path from the initial to the final contact points coincides with the length of a maximum length sheet.

16. The sheet cooling apparatus according to claim 1, wherein the first endless belt and the second endless belt are configured to be able to contact the entire range of the sheet in a direction perpendicular to the conveying direction and a curved sheet conveying path is formed between the first endless belt and the second endless belt.

17. The sheet cooling apparatus according to claim 1, further comprising a first cooling belt unit having the first endless belt and the first suspension roller;

a second cooling belt unit having the second endless belt and the second cooling roller;

a shaft member configured to be able to swing the first cooling belt unit and the second cooling belt unit with respect to each other; and an urged member configured to urge the first cooling belt unit and the second cooling belt unit toward each other and disposed on an opposite side of the shaft member with respect to the first cooling roller and the second cooling roller.

18. The sheet cooling apparatus according to claim 1, wherein the diameter of the first suspension roller is smaller than the diameter of the first cooling roller and the diameter of the second suspension roller is smaller than the diameter of the second cooling roller.

19. An image forming apparatus comprising:

an image forming portion that forms a toner image on a sheet;

a fixing device that nips and conveys the sheet in a fixing nip portion between a fixing member and a pressing member and fixes an unfixed toner image formed on the sheet by heating the toner image; and a sheet cooling apparatus that cools the sheet passed through the fixing device, the sheet cooling apparatus comprising:

a first cooling roller that is hollow inside;

a first suspension roller arranged downstream of the first cooling roller in a conveying direction;

a first endless belt that is suspended on the first cooling roller and the first suspension roller;

a second cooling roller that is hollow inside and arranged downstream of the first cooling roller in the conveying direction; and a second suspension roller arranged upstream of the second cooling roller in the conveying direction;

a second endless belt that is suspended on the second cooling roller and the second suspension roller;

a first cooling fan that blows cooling air into the hollow of the first cooling roller along a rotation axis of the first cooling roller in a fan blowing direction; and a second cooling fan that blows cooling air into the hollow of the second cooling roller along a rotation axis of the second cooling roller in the fan blowing direction, wherein a plurality of spiral-shaped heat radiation fins are disposed on an inner wall of the hollow inside of each of the first and second cooling rollers in the direction of the rotation axis of the first and second cooling rollers, respectively, the advancement directions of the plurality of spiral-shaped heat radiation fins of the first and second cooling rollers being opposite to each other with respect to the rotation axis direction of the first and second cooling rollers, respectively, and wherein a rotation direction of the first cooling roller is opposite to a rotation direction of the second cooling roller, whereby a fin blowing direction of the movement of the cooling air generated by the plurality of heat radiation fins of the first and second cooling rollers following rotation of the first and second cooling rollers, respectively, coincides with the fan blowing direction of the movement of the cooling air generated by the first and second cooling fans.

20. The image forming apparatus according to claim 19, wherein the diameter of the first suspension roller is smaller than the diameter of the first cooling roller and the diameter of the second suspension roller is smaller than the diameter of the second cooling roller.

* * * * *